US009863222B2

(12) United States Patent
Morrow et al.

(10) Patent No.: US 9,863,222 B2
(45) Date of Patent: Jan. 9, 2018

(54) SYSTEM AND METHOD FOR MONITORING FLUID FLOW IN A WELLBORE USING ACOUSTIC TELEMETRY

(71) Applicants: Timothy I. Morrow, Humble, TX (US); Michael C. Romer, The Woodlands, TX (US); Mark M. Disko, Glen Gardner, NJ (US)

(72) Inventors: Timothy I. Morrow, Humble, TX (US); Michael C. Romer, The Woodlands, TX (US); Mark M. Disko, Glen Gardner, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 67 days.

(21) Appl. No.: 14/876,935

(22) Filed: Oct. 7, 2015

(65) Prior Publication Data

US 2016/0208605 A1 Jul. 21, 2016

Related U.S. Application Data

(60) Provisional application No. 62/105,072, filed on Jan. 19, 2015.

(51) Int. Cl.
*E21B 47/16* (2006.01)
*E21B 43/12* (2006.01)
(Continued)

(52) U.S. Cl.
CPC ..... *E21B 43/122* (2013.01); *E21B 47/10* (2013.01); *E21B 47/14* (2013.01)

(58) Field of Classification Search
CPC ..... E21B 43/122; E21B 47/10; E21B 47/14
See application file for complete search history.

(56) References Cited

U.S. PATENT DOCUMENTS 4,314,365 A 2/1982 Peterson et al.
4,884,071 A 11/1989 Howard
(Continued)

FOREIGN PATENT DOCUMENTS

EP 0 636 763 A2 2/1995
EP 1 409 839 B1 4/2005
(Continued)

OTHER PUBLICATIONS

Emerson Process Management (2011), "Roxar downhole Wireless PT sensor system," www.roxar.com, or downhole@roxat.com, 2 pgs.

*Primary Examiner* — Omeed Alizada
(74) *Attorney, Agent, or Firm* — ExxonMobil Upstream Research Company—Law Department

(57) ABSTRACT

An electro-acoustic system for downhole telemetry is provided herein. The system employs a series of communications nodes spaced along a string of production tubing within a wellbore. The nodes allow for wireless communication between transceivers residing within the communications nodes and a receiver at the surface. More specifically, the transceivers provide for node-to-node communication up a wellbore at high data transmission rates for data indicative of fluid flow within the production tubing adjacent gas lift valves. A method of monitoring the flow of fluid gas lift valves is also provided herein. The method uses a plurality of data transmission nodes situated along the production tubing which send signals to a receiver at the surface. The signals are then analyzed to determine gas lift valve operation and fluid flow data.

46 Claims, 8 Drawing Sheets

(51) Int. Cl.
*E21B 47/10* (2012.01)
*E21B 47/14* (2006.01)

(56) References Cited

U.S. PATENT DOCUMENTS

| | | | |
|---|---|---|---|
| 5,128,901 | A | 7/1992 | Drumheller |
| 5,234,055 | A | 8/1993 | Comette |
| 5,480,201 | A | 1/1996 | Mercer |
| 5,495,230 | A | 2/1996 | Lian |
| 5,562,240 | A | 10/1996 | Campbell |
| 5,592,438 | A | 1/1997 | Rorden et al. |
| 5,850,369 | A | 12/1998 | Rorden et al. |
| 5,924,499 | A | 7/1999 | Birchak et al. |
| 5,995,449 | A | 11/1999 | Green et al. |
| 6,049,508 | A | 4/2000 | Deflandre |
| 6,429,784 | B1 | 8/2002 | Beique et al. |
| 6,462,672 | B1 | 10/2002 | Besson |
| 6,670,880 | B1 | 12/2003 | Hall et al. |
| 6,695,277 | B1 | 2/2004 | Gallis |
| 6,717,501 | B2 | 4/2004 | Hall et al. |
| 6,816,082 | B1 | 11/2004 | Laborde |
| 6,868,037 | B2 | 3/2005 | Dasgupta et al. |
| 6,899,178 | B2 | 5/2005 | Tubel |
| 6,912,177 | B2 | 6/2005 | Smith |
| 6,956,791 | B2 | 10/2005 | Dopf et al. |
| 6,980,929 | B2 | 12/2005 | Aronstam et al. |
| 6,987,463 | B2 | 1/2006 | Beique et al. |
| 7,006,918 | B2 | 2/2006 | Economides et al. |
| 7,064,676 | B2 | 6/2006 | Hall et al. |
| 7,082,993 | B2 | 8/2006 | Ayoub et al. |
| 7,140,434 | B2 | 11/2006 | Chouzenoux et al. |
| 7,224,288 | B2 | 5/2007 | Hall et al. |
| 7,249,636 | B2 | 7/2007 | Ohmer |
| 7,257,050 | B2 | 8/2007 | Stewart et al. |
| 7,277,026 | B2 | 10/2007 | Hall et al. |
| 7,317,990 | B2 | 1/2008 | Sinha et al. |
| 7,348,893 | B2 | 3/2008 | Huang et al. |
| 7,411,517 | B2 | 8/2008 | Flanagan |
| 7,477,160 | B2 | 1/2009 | Lemenager et al. |
| 7,516,792 | B2 | 4/2009 | Lonnes et al. |
| 7,595,737 | B2 | 9/2009 | Fink et al. |
| 7,602,668 | B2 | 10/2009 | Liang et al. |
| 7,649,473 | B2 | 1/2010 | Johnson et al. |
| 7,775,279 | B2 | 8/2010 | Marya et al. |
| 8,044,821 | B2 | 10/2011 | Mehta |
| 8,049,506 | B2 | 11/2011 | Lazarev |
| 8,115,651 | B2 | 2/2012 | Camwell et al. |
| 8,162,050 | B2 | 4/2012 | Roddy et al. |
| 8,220,542 | B2 | 7/2012 | Whitsitt et al. |
| 8,237,585 | B2 | 8/2012 | Zimmerman |
| 8,242,928 | B2 | 8/2012 | Prammer |
| 8,330,617 | B2 | 12/2012 | Chen et al. |
| 8,347,982 | B2 | 1/2013 | Hannegan et al. |
| 8,381,822 | B2 | 2/2013 | Hales et al. |
| 8,434,354 | B2 | 5/2013 | Crow et al. |
| 8,496,055 | B2 | 7/2013 | Mootoo et al. |
| 8,539,890 | B2 | 9/2013 | Tripp et al. |
| 8,544,564 | B2 | 10/2013 | Moore et al. |
| 8,683,859 | B2 | 4/2014 | Godager |
| 8,689,621 | B2 | 4/2014 | Godager |
| 8,826,980 | B2 | 9/2014 | Neer |
| 8,833,469 | B2 | 9/2014 | Purkis |
| 2002/0026958 | A1 | 3/2002 | Brisco |
| 2002/0043369 | A1 | 4/2002 | Vinegar et al. |
| 2003/0056953 | A1 | 3/2003 | Tumlin et al. |
| 2004/0065443 | A1 | 4/2004 | Berg et al. |
| 2004/0073370 | A1 | 4/2004 | Dasgupta et al. |
| 2004/0084190 | A1 | 5/2004 | Hill et al. |
| 2004/0105342 | A1 | 6/2004 | Gardner et al. |
| 2004/0256113 | A1 | 12/2004 | LoGiudice et al. |
| 2005/0024231 | A1 | 2/2005 | Fincher et al. |
| 2005/0039912 | A1 | 2/2005 | Hall et al. |
| 2005/0145010 | A1 | 7/2005 | Vanderveen et al. |
| 2005/0284659 | A1 | 12/2005 | Hall et al. |
| 2006/0002232 | A1 | 1/2006 | Shah et al. |
| 2006/0115095 | A1 | 6/2006 | Giesbrecht et al. |
| 2006/0124310 | A1 | 6/2006 | Lopez de Cardenas et al. |
| 2006/0133203 | A1 | 6/2006 | James et al. |
| 2007/0024464 | A1 | 2/2007 | Lemenager et al. |
| 2007/0029112 | A1 | 2/2007 | Li et al. |
| 2007/0030762 | A1 | 2/2007 | Huang et al. |
| 2007/0139217 | A1 | 6/2007 | Beique et al. |
| 2009/0045974 | A1 | 2/2009 | Patel |
| 2009/0159272 | A1 | 6/2009 | Auzerais et al. |
| 2009/0277688 | A1 | 11/2009 | Oothoudt |
| 2009/0289808 | A1 | 11/2009 | Prammer |
| 2010/0013663 | A1 | 1/2010 | Cavender et al. |
| 2010/0126718 | A1 | 5/2010 | Lilley |
| 2010/0157739 | A1 | 6/2010 | Slocum et al. |
| 2010/0176813 | A1 | 7/2010 | Simon |
| 2010/0194584 | A1 | 8/2010 | Savage |
| 2011/0066378 | A1 | 3/2011 | Lerche et al. |
| 2011/0168403 | A1 | 7/2011 | Patel |
| 2011/0186290 | A1 | 8/2011 | Roddy et al. |
| 2011/0275313 | A1 | 11/2011 | Baldemair et al. |
| 2011/0280294 | A1 | 11/2011 | Luo et al. |
| 2011/0297376 | A1 | 12/2011 | Holderman et al. |
| 2012/0017673 | A1 | 1/2012 | Godager |
| 2012/0024050 | A1 | 2/2012 | Godager |
| 2012/0024052 | A1 | 2/2012 | Eriksen |
| 2012/0043079 | A1 | 2/2012 | Wassouf et al. |
| 2012/0090687 | A1 | 4/2012 | Grisby et al. |
| 2012/0170410 | A1 | 7/2012 | Hay |
| 2012/0241172 | A1 | 9/2012 | Ludwig et al. |
| 2012/0256415 | A1 | 10/2012 | Dole |
| 2012/0256492 | A1 | 10/2012 | Song et al. |
| 2012/0257475 | A1 | 10/2012 | Luscombe et al. |
| 2013/0008648 | A1 | 1/2013 | Lovom et al. |
| 2013/0106615 | A1 | 5/2013 | Prammer |
| 2013/0110402 | A1 | 5/2013 | Godager |
| 2013/0175094 | A1 | 7/2013 | Ross et al. |
| 2013/0248172 | A1 | 9/2013 | Angeles Boza et al. |
| 2013/0248174 | A1 | 9/2013 | Dale et al. |
| 2014/0152659 | A1 | 6/2014 | Davidson et al. |
| 2014/0266769 | A1 | 9/2014 | van Zelm |
| 2014/0327552 | A1 | 11/2014 | Filas et al. |
| 2014/0352955 | A1 | 12/2014 | Tubel et al. |
| 2015/0003202 | A1 | 1/2015 | Palmer et al. |
| 2015/0009040 | A1 | 1/2015 | Bowles et al. |
| 2015/0027687 | A1 | 1/2015 | Tubel |

FOREIGN PATENT DOCUMENTS

| | | | |
|---|---|---|---|
| WO | WO 2010/074766 | A1 | 7/2010 |
| WO | WO 2013/079928 | A2 | 6/2013 |
| WO | WO 2013/079929 | A2 | 6/2013 |
| WO | WO 2013/112273 | A2 | 8/2013 |
| WO | WO 2014/018010 | A1 | 1/2014 |
| WO | WO 2014/049360 | A2 | 4/2014 |
| WO | WO 2014/134741 | A1 | 9/2014 |

SYSTEM AND METHOD FOR MONITORING FLUID FLOW IN A WELLBORE USING ACOUSTIC TELEMETRY

CROSS REFERENCE TO RELATED APPLICATIONS

This application claims the benefit of U.S. Provisional Application No. 62/105,072, filed Jan. 19, 2015. This application is related to International Publication No. WO 2014/100272, entitled "Apparatus and Method for Monitoring Fluid Flow in a Wellbore Using Acoustic Signals" and is incorporated by reference herein in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of well completions. More specifically, the invention relates to a wellbore having a plurality of nodes that facilitate the wireless transmission of data along a production tubing. The present invention further relates to the monitoring of fluid flow within a wellbore using acoustic signals.

General Discussion of Technology

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string may be referred to as surface casing. The surface casing serves to isolate and protect the shallower, fresh water-bearing aquifers from contamination by any other wellbore fluids. Accordingly, this casing string is almost always cemented entirely back to the surface.

A process of drilling and then cementing progressively smaller strings of casing is repeated several times below the surface casing until the well has reached total depth. In some instances, the final string of casing is a liner, that is, a string of casing that is not tied back to the surface. The final string of casing, referred to as a production casing, is also typically cemented into place.

In some completions, the production casing (or liner) has swell packers spaced across the productive intervals. This creates annular compartments between the swell packers for isolation of zones during stimulation treatments and production. In this instance, the annulus may simply be packed with sand.

As part of the completion process, the production casing is perforated at a desired level. This means that lateral holes are shot through the casing and the cement column surrounding the casing. The perforations allow reservoir fluids to flow into the wellbore. In the case of swell packers or individual compartments, the perforating gun penetrates the casing, allowing reservoir fluids to flow from the rock formation into the wellbore along a corresponding zone.

Additional tubular bodies may be included in a well completion. These include one or more strings of production tubing placed within the production casing or liner. Each tubing string extends from the surface to a designated depth proximate a production interval, or "pay zone." Each tubing string may be attached to a packer. The packer serves to seal off the annular space between the production tubing string(s) and the surrounding casing.

In some instances, the pay zones are incapable of flowing fluids to the surface efficiently. This may be because the reservoir pressure is insufficient to overcome the hydrostatic head in the production tubing. When this occurs, the operator may include artificial lift equipment as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. In addition, gas lift valves may be installed along the production tubing to assist fluid flow to the surface.

Gas lift systems increase well production by injecting a stream of gas via the annulus deep into the wellbore. The gas stream enters one or more gas lift valves (preferably the lowermost valve) located in the gas lift mandrels along the annulus. The gas lift valves are typically placed along the production tubing just above the production packer.

In practice, gas is injected from the surface, down the annulus, and into the bottom of the valves. Typically, the gas that is injected is recycled gas produced from the well. The injected gas reduces the pressure on the bottom of the well by decreasing the density of the fluids in the well. This, in turn, encourages the fluids to flow more easily to the surface. In addition, the presence of gas in the wellbore reduces the bottomhole pressure which allows the in situ reservoir pressure to drive more reservoir fluids into the wellbore.

A substantial volume of the world's oil production is on gas lift. $CO_2$ tracer testing suggests that a number of these gas-lifted wells are not performing optimally. When gas lifted wells are optimized by gas lift technicians, substantially increased production is often achieved. Thus, global gas lift optimization and automation can lead to increased oil production and more efficient field management.

Currently, systems do not exist for continuously monitoring downhole gas lift gas injection volumes and efficiencies. Current well tracer technology can be resource intensive. Therefore, a need exists for a network of downhole sensors that can be installed in gas lifted wells and which can provide real-time surveillance data. Further, a need exists for a network of nodes that can deliver data signals indicative of the location of lift-gas entry into the production tubing and the lift gas flow rate.

SUMMARY OF THE INVENTION

An electro-acoustic system for downhole telemetry is provided herein. The system employs a series of communications nodes spaced along a wellbore. Each node transmits a signal that represents a packet of information. The packet of information includes both a node identifier and an acoustic wave. The signals are relayed up the wellbore from node-to-node in order to provide a wireless signal to a receiver at the surface indicative of fluid flow measurements.

The present system is designed to provide the operator of a wellbore with data concerning the performance of gas lift valves. The gas lift valves reside along a string of production tubing. The acoustic signals are sent from the gas lift valves up the production tubing and to a receiver at the surface. Thus, the electro-acoustic system is designed to enable the operator to monitor fluid flow in production tubing along the individual gas lift valves.

The system first includes a production tubing disposed in the wellbore. The production tubing is comprised of threadedly-connected pipe joints. The wellbore is completed for the purpose of conducting hydrocarbon recovery operations, with hydrocarbon fluids moving up the production tubing. Preferably, a production packer resides proximate a bottom of the production tubing. The production packer resides at a lower end of the production tubing and seals the annulus between the production tubing and a surrounding string of casing.

The system also includes one or more gas lift valves. Preferably, three or more gas lift valves are placed along the production tubing, preferably in individual side pocket mandrels above the production packer.

At least one sensor is disposed along the wellbore adjacent each of the one or more gas lift valves. Each sensor is designed to measure a parameter indicative of fluid flow within the wellbore. The sensors operate to measure parameters indicative of fluid flow. The sensors may be any of:

- fluid velocity measurement devices residing inside of the production tubing;
- temperature sensors that measure temperature of fluids flowing inside of the production tubing;
- pressure sensors that measure pressure inside of the production tubing, or pressure drop across a gas lift valve;
- sensors for detecting injected gas, bubbles, and multiphase flows;
- fluid density sensors that measure the density of fluids inside of the production tubing;
- microphones that provide passive acoustic monitoring to listen for the sound of gas entry into the production tubing or the opening and closing of a gas lift valve;
- ultrasound sensors that correlate changes in gas transmission with gas flows, bubbles, solids and other properties of flow along gas inlets;
- Doppler shift sensors;
- chemical sensors;
- an imaging device; or
- combinations thereof to produce direct or "virtual" sensors of gas lift valve operation and related flows of gas, liquids and solids.

The system also includes one or more sensor communications nodes. Each sensor communications node is placed along the wellbore and is connected to the production tubing adjacent a corresponding gas lift valve. Further, each sensor communications node is in electrical communication with an associated sensor, and is configured to receive signals from the associated sensor indicative of fluid flow. Each of the sensor communications nodes is additionally configured to receive signals from the associated sensor, and relay acoustic signals indicative of readings taken by the sensors. The packet of information in each signal comprises an identifier for the sensor communications node that originally transmitted the signal.

The system further has a topside communications node. The topside communications node may be placed along the production tubing proximate the surface. The surface may be an earth surface. Alternatively, in a subsea context, the surface may be an offshore platform at a water level. In another embodiment, the topside communications node is connected to the well head.

The system further includes a plurality of intermediate communications nodes. The intermediate communications nodes are preferably clamped to an outer wall of the production tubing in spaced-apart relation. In one aspect, the communications nodes are spaced at between about 10 to 1,000 foot (3.0 to 304.8 meter) intervals or, more preferably, at between about 40 and 70 foot (12.2 to 21.3 meter) intervals. Preferably, each joint of pipe making up the tubing string receives one node, although one or more joints may be skipped depending on the casing type and the surrounding media. The communications nodes are configured to transmit acoustic waves from node-to-node, up to the topside communications node.

Each of the subsurface communications nodes has a sealed housing for protecting internal electronics. In addition, each node relies upon an independent power source. The power source may be, for example, batteries or a fuel cell. The power source resides within the housing. It is noted though that for the sensor communications nodes, the associated sensor may reside either within the housing or, alternatively, external to the housing but within the gas lift valve. In either instance, an electro-acoustic transducer within the associated sensor communications node converts signals from the sensor into acoustic signals for the associated transceiver.

In addition, each of the subsurface communications nodes has an electro-acoustic transducer. In one aspect, the communications nodes transmit data as mechanical waves at a rate exceeding about 50 bps. In one aspect, the electro-acoustic transducer is associated with a transceiver designed to receive acoustic waves at a first frequency, and then transmit or relay the acoustic waves at a second different frequency. Multiple frequency shift keying (MFSK) may be used as a modulation scheme enabling the transmission of information.

The system also includes a receiver. The receiver is positioned at the surface and is configured to receive signals from the topside communications node. The signals originate with selected subsurface communications nodes, which may be referred to as sensor communications nodes. In one aspect, the receiver is in electrical communication with the topside communications node by means of an electrical wire. In another aspect, the receiver is in electrical communication with the topside communications node through a wireless data transmission such as radio, ZigBee, Wi-Fi or Blue Tooth.

A method of monitoring fluid flow along a wellbore is also provided herein. The method uses a plurality of communications nodes situated along the wellbore to accomplish a wireless transmission of data. The data represents signals that indicate the presence or nature of fluid flow through the production tubing adjacent gas lift valves. Sensors are provided that combine one or more physical/chemical measurements to detect fluid, gas, and solid mixed phase flows.

The method first includes running joints of production tubing into the wellbore. The joints are connected by threaded couplings to form a pipe string. The joints of pipe are fabricated from a steel material and have a resonance frequency.

The wellbore is completed for the purpose of conducting hydrocarbon recovery operations. Accordingly, the method also includes placing one or more gas lift valves along the pipe string. Preferably, the gas lift valves are located in side pocket mandrels along the production tubing.

The method also provides for placing at least one sensor along the wellbore adjacent each of the one or more gas lift valves. Each sensor is designed to measure a parameter indicative of fluid flow within the wellbore. The sensors may be any of the sensors listed above.

The method next includes attaching one or more sensor communications nodes to the production tubing. The sensor communications nodes are attached adjacent a corresponding gas lift valve. Each sensor communications node is in electrical communication with an associated sensor, and is configured to receive signals from the associated sensor indicative of fluid flow.

The method also provides for attaching a topside communications node to the wellbore proximate the surface. In one aspect, the topside communications node is attached to an uppermost joint of pipe node along the wellbore. Alternatively, and more preferably, the topside communications node is connected to the well head above grade.

The method additionally includes attaching a series of intermediate communications nodes along the wellbore according to a pre-designated spacing. In one aspect, each joint of pipe receives at least one communications node. The joints of pipe may be production tubing, casing, or combinations thereof. Preferably, each of the subsurface communications nodes is attached to a joint of production tubing by one or more clamps. In this instance, the step of attaching the communications nodes to the joints of pipe comprises clamping the communications nodes to an outer surface of the production tubing.

The intermediate communications nodes are configured to transmit acoustic waves, or waveforms, from the sensor communications nodes, node-to-node up the wellbore and to the topside communications node. Each intermediate communications node includes a transceiver that receives an acoustic signal from a previous communications node, and then transmits or relays that acoustic signal to a next communications node, in node-to-node arrangement. In one aspect, the communications nodes transmit data as mechanical waves at a rate exceeding about 50 bps. The intermediate communications nodes are configured as described above.

The sensor communications nodes generate a signal that corresponds to readings sensed by the respective sensors. Electro-acoustic transceivers in the subsurface communications nodes then transmit acoustic signals up the wellbore representative of fluid flow. Fluid flow may include flow rate, fluid identification, pressure, sound and/or temperature readings, transmitted node-to-node. The topside communications node transmits signals to the receiver at the surface.

In one aspect, each of the sensors resides within the housing of an associated sensor communications node. An electro-acoustic transducer within the associated sensor communications node converts signals from the sensors into acoustic signals. In another aspect, each of the one or more sensors resides adjacent to the housing of its associated sensor communications node. Each of the one or more sensors is in electrical communication with its corresponding sensor communications node. The electro-acoustic transducer within the associated sensor communications node converts signals from the sensors into acoustic signals for the associated transceivers.

In any instance, the transceiver in each sensor communications node is configured to send its acoustic signals indicative of fluid flow data (i) according to a pre-programmed schedule, (ii) in the event that a condition of gas lift valve failure is identified, or (iii) only when interrogated by a user at the surface.

The method next includes providing a receiver. The receiver is placed at the surface. The receiver has a processor that processes signals received from the topside communications node, such as through the use of firmware and/or software. The receiver preferably receives electrical or optical signals via a so-called "Class I, Division I" conduit, meaning a conduit (as defined by NFPA 497 and API 500) for operation in an electrically classified area. Alternatively, data may be transferred from the topside communications node to the receiver via an electromagnetic (RF) wireless connection or other wireless protocol. The processor processes the signals to identify which signals correlate to which sensor communications node.

The method also includes analyzing the signals to determine the efficiency or operation of the gas lift valve system along the production tubing.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 5A, the leading edge, or front, of the shoe is seen. In FIG. 5B, the back of the shoe is seen.

DETAILED DESCRIPTION OF CERTAIN EMBODIMENTS

Definitions

Figure 1A:
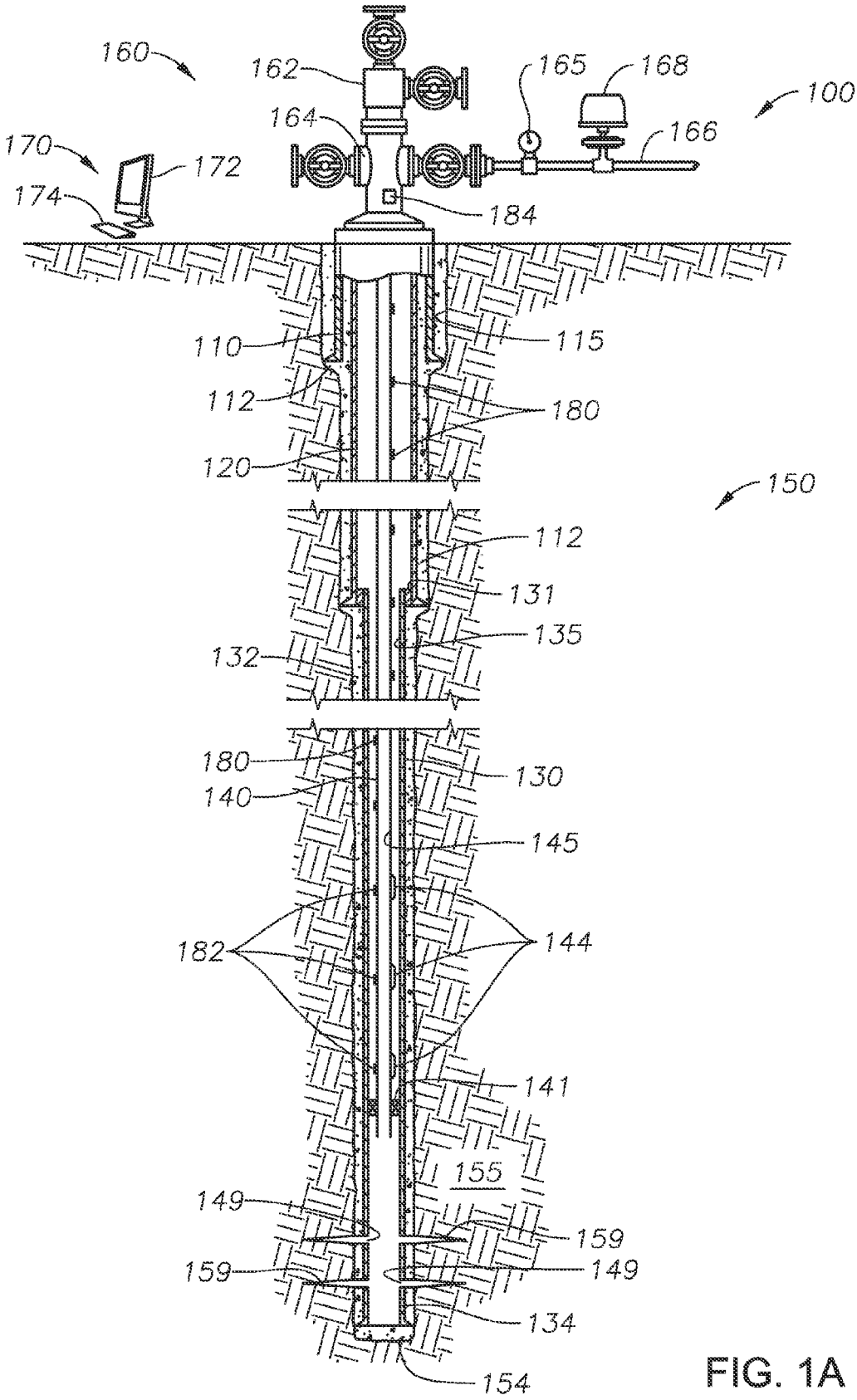
FIG. 1A is a side, cross-sectional view of an illustrative wellbore. The wellbore is completed substantially vertically, and has a string of production tubing therein. A series of communications nodes is placed along the tubing as part of a telemetry system.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "sensor" includes any electrical sensing device or gauge. The sensor may be capable of monitoring or detecting pressure, temperature, fluid flow, vibration, fluid type, resistivity, flow rate or other fluid flow data.

As used herein, the term "gas" refers to a fluid that is in its vapor phase.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

The terms "tubular member" or "tubular body" refer to any pipe, such as a joint of casing, a portion of a liner, a drill string, a production tubing, an injection tubing or a pup joint. "Tubular body" may also include sand control screens, inflow control devices or valves, sliding sleeve joints, and pre-drilled or slotted liners.

As used herein, the term "wellbore" refers to a hole in the subsurface made by drilling or insertion of a conduit into the subsurface. A wellbore may have a substantially circular cross section, or other cross-sectional shapes. As used herein, the term "well," when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells historically have been completed in substantially vertical orientation, it is understood that wells now are frequently inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1A is a side, cross-sectional view of an illustrative well site 100. The well site 100 includes a wellbore 150 extending from an earth surface or seafloor, 101 and down into an earth subsurface 155. The illustrative wellbore 150 is completed for the purpose of producing hydrocarbons in commercially viable quantities.

The wellbore 150 has been completed with a series of pipe strings, referred to as casing. First, a string of surface casing 110 has been cemented into the formation. Cement is shown in an annular bore 115 of the wellbore 150 around the casing 110. The cement is in the form of an annular sheath 112. The surface casing 110 has an upper end in sealed connection with a lower valve 164.

Next, at least one intermediate string of casing 120 is cemented into the wellbore 150. The intermediate string of casing 120 is in sealed fluid communication with an upper valve 162. A cement sheath 112 is again shown in a bore 115 of the wellbore 150. The combination of the casing 110/120 and the cement sheath 112 in the bore 115 strengthens the wellbore 150 and facilitates the isolation of formations behind the casing 110/120.

It is understood that a wellbore 150 may, and typically will, include more than one string of intermediate casing. In some instances, an intermediate string of casing may be a liner. It is also understood that the upper valve 162 and the lower valve 164 are part of a well head 160, which is schematically shown. The wellhead 160 will include various valves for controlling the flow of fluids into and out of the wellbore 150.

In addition, a production string 130 is provided. The production string 130 is hung from the intermediate casing string 120 using a liner hanger 131. The production string 130 is a liner that is not tied back to the surface 101. In the arrangement of FIG. 1A, a cement sheath 132 is provided around the liner 130.

The production string 130 extends into the subsurface formation 155. The production string 130 has a lower end 134 that traverses to an end 154 of the wellbore 150. For this reason, the wellbore 150 is said to be completed as a cased-hole well.

The production string 130 has been perforated after cementing. Perforations are shown at 149. The perforations 149 create fluid communication between a bore 135 of the liner 130 and the surrounding rock matrix making up the subsurface formation 155.

The wellbore 150 finally includes a string of production tubing 140. The production tubing 140 extends from the wellhead 160 down to the subsurface formation 155. In the arrangement of FIG. 1A, the production tubing 140 terminates above the perforations 149. However, it is understood that the production tubing 140 may terminate anywhere along the subsurface formation 155.

A production packer 141 is provided along the production tubing 140. The illustrative packer 141 is placed proximate the top of the subsurface formation 155. In this way, the packer 141 is able to seal off the annular region 135 between the tubing 140 and the surrounding production liner 130.

The wellbore 150 includes one or more gas lift valves 144. The gas lift valves 144 reside along the production tubing 140 above the packer 141. The gas lift valves 144 receive gas injected into the annulus 135 between the production tubing 140 and the surrounding casing 130. The gas lift valves 144 then inject that gas into the bore 145 of the production tubing 140 for the purpose of reducing the density of the wellbore fluids.

In order to inject the gas, a gas injection line 166 is provided along the wellhead 160. The wellhead 160 includes a gauge 165 and a pressure regulator 168. Typically, the gas that is injected is separated gas that has been produced from the subsurface formation 155. A gas compressor (not shown) that is located at the surface 101 near the well site 100 pressurizes gas that is communicated to the annulus 135 of the wellbore 150.

It is desirable to implement a downhole telemetry system that enables the operator to monitor the flow of fluids in the production tubing 140 adjacent the gas lift valves 144. This enables the operator to optimize the efficiency of the gas lift system. For example, the operator may be able to determine that one of the gas lift valves is not opening or closing properly, or is not bringing in enough gas, or is bringing in too little gas.

To do this, the well site 100 includes a plurality of subsurface communications nodes. The subsurface communications nodes include one or more sensor communications nodes 182, a series of intermediate communications nodes 180, and a topside communications node 184. The sensor communications nodes 182 are placed adjacent respective gas lift valves 144, while the intermediate communications nodes 180 are placed along the production tubing 140 according to a pre-designated spacing, while. Optionally, some intermediate communications nodes 180 are placed along the surface casing 110. The communications nodes 180, 182 send acoustic signals up the wellbore 150 in node-to-node arrangement to the topside communications node 184.

The communications nodes 180, 182 send signals using acoustic telemetry. Acoustic telemetry systems are known in the industry. U.S. Pat. No. 5,924,499 entitled "Acoustic Data Link and Formation Property Sensor for Downhole MWD System" teaches the use of acoustic signals for "short hopping" a component along a drill string. Signals are transmitted from the drill bit or from a near-bit sub and across the mud motors. This may be done by sending separate acoustic signals simultaneously—one that is sent through the drill string, a second that is sent through the drilling mud, and optionally, a third that is sent through the formation. These signals are then processed to extract readable signals.

U.S. Pat. No. 6,912,177, entitled "Transmission of Data in Boreholes," addresses the use of an acoustic transmitter that is as part of a downhole tool. Here, the transmitter is provided adjacent a downhole obstruction such as a shut-in valve along a drill stem so that an electrical signal may be sent across the drill stem. U.S. Pat. No. 6,899,178, entitled "Method and System for Wireless Communications for Downhole Applications," describes the use of a "wireless tool transceiver" that utilizes acoustic signaling. Here, an acoustic transceiver is in a dedicated tubular body that is integral with a gauge and/or sensor. This is described as part of a well completion.

U.S. Pat. No. 4,314,365 entitled "Acoustic Transmitter and Method to Produce Essentially Longitudinal, Acoustic Waves, teaches a "portable, electrohydraulic, acoustic transmitter" that attaches to an outer surface of a drill string. The transmitter is used to send acoustic signals down a drill string to a downhole receiver. When actuated, the downhole receiver activates a subsurface "instrument package" which performs a desired "downhole function."

None of these patents disclose an acoustic telemetry system that enables an operator to wirelessly receive signals at the surface that are indicative of fluid flow within a wellbore during production. In contrast, the well site 100 of FIG. 1A presents a telemetry system that utilizes a series of novel communications nodes 180, 182 placed along the wellbore 150. These nodes 180, 182 allow for the high speed transmission of wireless signals based on the in situ generation of acoustic waves. The waves represent wave forms that may be processed and analyzed at the surface.

As noted, the nodes first include a plurality of intermediate communications nodes 180. The intermediate communications nodes 180 are configured to transmit acoustic signals along the length of the wellbore 150 up to a topside communications node 184. The topside communications node 184 is actually the uppermost intermediate communications node. The topside communications node 184 is placed closest to the surface 101. The topside communications node 184 is configured to receive acoustic signals and convert them to electrical or optical signals. The topside communications node 184 may be above grade or below grade. In the arrangement of FIG. 1A, the topside communications node 184 is connected to the wellhead 160.

In FIG. 1A, the intermediate communications nodes 180 and the topside communications node 184 are shown schematically. However, FIG. 3 offers an enlarged perspective view of an illustrative pipe joint 300, along with an illustrative communications node 350. The communications node 350 is shown exploded away from the pipe joint 300.

Figure 3:
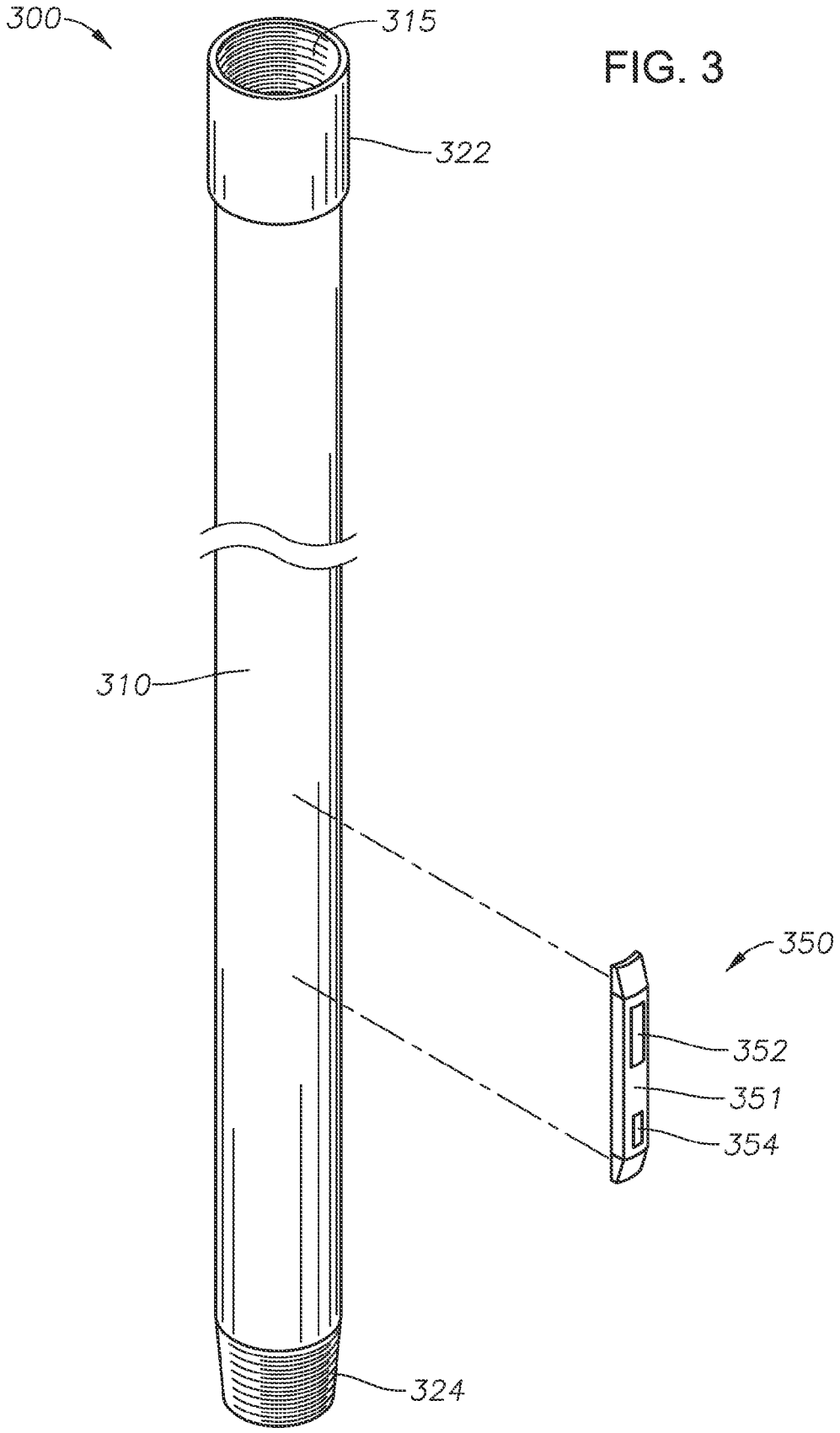
FIG. 3 is a perspective view of an illustrative pipe joint. A communications node of the present invention, in one embodiment, is shown exploded away from the pipe joint.

In FIG. 3, the pipe joint 300 is intended to represent a joint of production tubing. However, the pipe joint 300 may be any other tubular body such as a joint of casing. The pipe joint 300 has an elongated wall 310 defining an internal bore 315. The bore 315 transmits fluids such as production fluids during a production operation.

The pipe joint 300 has a box end 322 having internal threads. In addition, the pipe joint 300 has a pin end 324 having external threads. The threads may be of any design.

As noted, an illustrative communications node 350 is shown exploded away from the pipe joint 300. The communications node 350 is designed to attach to the wall 310 of the pipe joint 300 at a selected location. In one aspect, each pipe joint 300 will have a communications node 350 between the box end 322 and the pin end 324. In one arrangement, the communications node 350 is placed immediately adjacent the box end 322 or, alternatively, immediately adjacent the pin end 324 of every joint of pipe. In another arrangement, the communications node 350 is placed at a selected location along every second or every third pipe joint 300 in a drill string 160. In still another arrangement, at least some pipe joints 300 (such as a production tubing) receive two communications nodes 350.

The communications node 350 shown in FIG. 3 is designed to be pre-welded onto the wall 310 of the pipe joint 300. Alternatively, the communications node 350 may be glued using an adhesive such as epoxy. However, it is preferred that the communications node 350 be configured to be selectively attachable to/detachable from a pipe joint 300 by mechanical means at a well site. This may be done, for example, through the use of clamps. Such a clamping system is shown at 600 in FIG. 6, described more fully below. In any instance, the communications node 350 is an independent wireless communications device that is designed to be attached to an external surface of a well pipe.

There are benefits to the use of an externally-placed communications node that uses acoustic waves. For example, such a node will not interfere with the flow of fluids within the internal bore 315 of the pipe joint 300. Further, installation and mechanical attachment can be readily assessed and adjusted.

In FIG. 3, the communications node 350 includes an elongated body 351. The body 351 supports one or more batteries, shown schematically at 352. The body 351 also supports an electro-acoustic transducer, shown schematically at 354. The electro-acoustic transducer 354 is associated with a transceiver that transmits acoustic signals to a next communications node.

The communications node 350 is intended to represent the communications nodes 180 of FIG. 1A, in one embodiment. The electro-acoustic transducer 354 in each node 180 allows signals to be sent from node-to-node, up the wellbore 150, as acoustic waves. The acoustic waves may be at a frequency of, for example, between about 50 kHz and 500 kHz. A last intermediate communications node 180 transmits the signals to the topside node 184. Beneficially, the intermediate communications nodes 180 do not require a wire or cable to transmit data to the surface 101. Preferably, communication is routed around any nodes 180 which are broken.

The well site 100 of FIG. 1A also shows a receiver 170. The receiver 170 comprises a processor 172 that receives signals sent from the topside communications node 184. The signals may be received through a wire (not shown) such as a co-axial cable, a fiber optic cable, a USB cable, or an electrical conduit or optical communications wire. Alternatively, the receiver 170 may receive the signals from the topside communications node 184 wirelessly through a modem, a transceiver or other wireless communications link such as IR, ZigBee, Bluetooth or Wi-Fi. The receiver 170 preferably receives electrical signals via a so-called Class I, Division I conduit, that is, a housing for wiring that is considered acceptably safe in an explosive environment. In some applications, radio, infrared or microwave signals may be utilized.

The processor 172 may include discrete logic, any of various integrated circuit logic types, or a microprocessor. In any event, the processor 172 may be incorporated into a computer having a screen. The computer may have a separate keyboard 174, as is typical for a desk-top computer, or an integral keyboard as is typical for a laptop or a personal digital assistant. In one aspect, the processor 172 is part of a multi-purpose "smart phone" having specific "apps" and wireless connectivity through a cellular network.

As noted, the downhole telemetry system also includes sensor communications nodes 182. The sensor communications nodes 182 are in electrical communication with associated sensors (a sensor is shown at 188 in FIG. 1B). The sensors 188 may reside external to their associated nodes 182, though preferably the sensors reside within a housing (seen at 410 in FIG. 4A) of the sensor communications nodes 182.

Figure 1B:
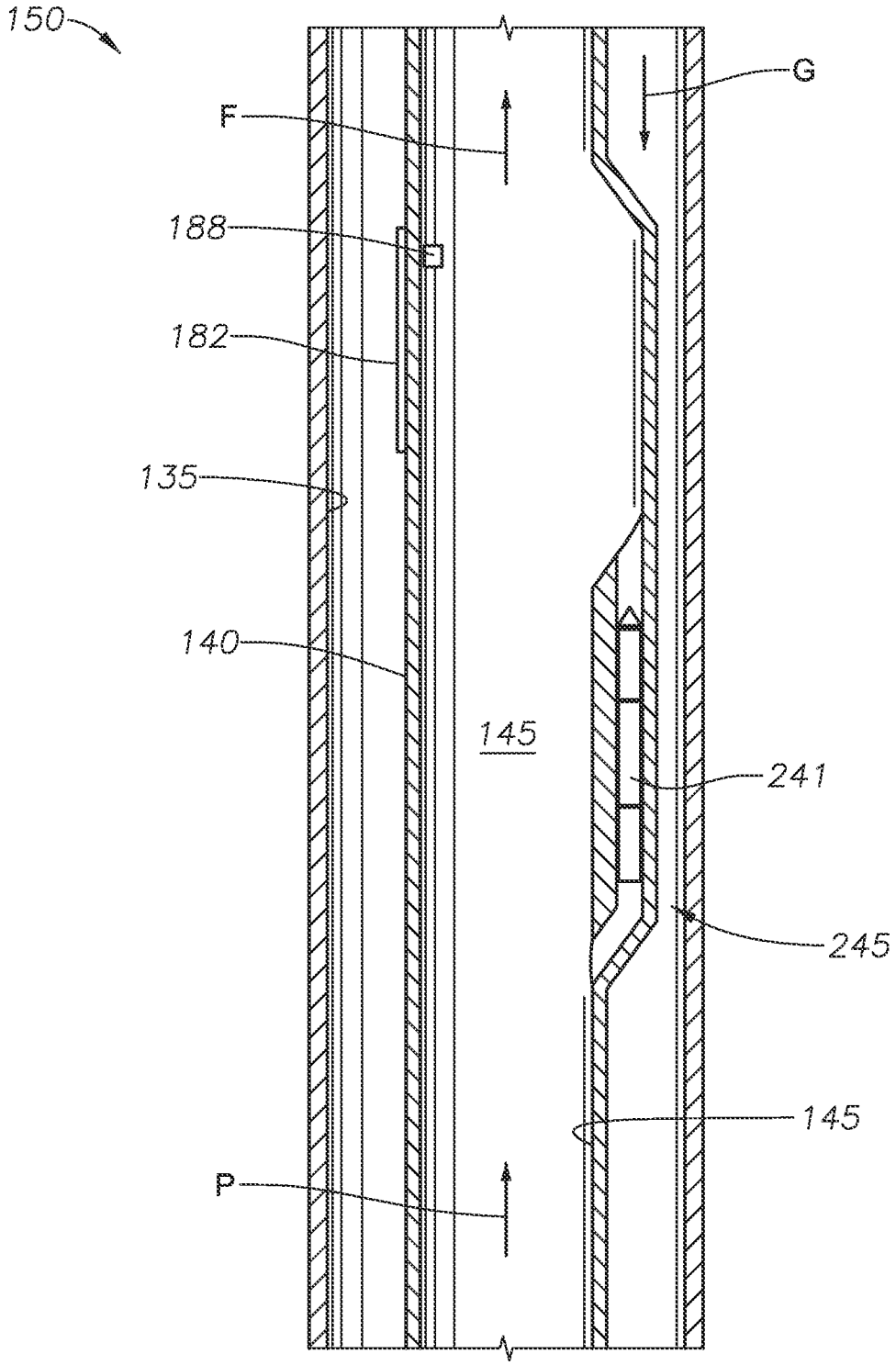
FIG. 1B is an enlarged cross-sectional view of a portion of the illustrative wellbore of FIG. 1A. Here, a gas lift valve and associated sensor communications node are seen more clearly along the production tubing.

FIG. 1B provides an enlarged cross-sectional view of a portion of the illustrative wellbore 150 of FIG. 1A. Here, a gas lift valve 241 is visible. The gas lift valve 241 resides in a side pocket mandrel 245 as is known in the industry. The gas lift valve 241 typically contains a check valve element that opens to allow fluid flow from the annulus 135 into the production tubing bore 145, and closes when the fluid would otherwise flow in the opposite direction. The use of side pocket mandrels 245 for gas lift valves obviates the need for a major workover to replace a defective valve.

In FIG. 1B, Arrow "P" indicates that production fluids, primarily hydrocarbons, are moving up the bore 145 of the production tubing 140. At the same time, Arrow "G" indicates that gas is being injected down the annulus 135. The gas "G" will enter the valve 241, and then be injected into the bore 145 where it will commingle with the production fluids "P." Commingled fluids, indicated at Arrow "F," then flow up the bore 145 and to the surface 101.

Those of ordinary skill in the art will understand that the column of production fluids "P" that is present in the production tubing 140 may suppress the rate at which the fluids "P" are produced from the formation 155. More specifically, the column of well fluid inside the production tubing 140 exerts a hydrostatic pressure that increases with well depth. Thus, near a particular producing formation, the hydrostatic pressure may be significant enough to substantially slow down the rate at which the well fluids are produced from the formation 155.

To reduce the hydrostatic pressure and thus, enhance the rate at which fluids "P" are produced, gas "G" is injected into the bore 145. The commingling of the productions fluids "P" with the lighter gas "G" reduces the hydrostatic pressure inside the production tubing 140 and allows reservoir fluids to enter the bore 145 at a higher flow rate.

Also visible in FIG. 1B is a sensor communications node 182. The communications node 182 is in electrical communication with a sensor 188. The sensor 188 measures a fluid flow parameter. The sensors 188 in the wellbore 150 may be any of:

(i) fluid velocity measurement devices residing inside of the production tubing 140 (such as an axial turbine flow meter, referred to as a "spinner" on production logging tools, where the speed of the rotating spinner is proportional to the fluid velocity);

(ii) temperature sensors that measure temperature of fluids flowing inside of the production tubing;

(iii) pressure sensors that measure pressure inside of the production tubing, or pressure drop across a gas lift valve;

(iv) fluid density sensors that measure the density of fluids inside of the production tubing;

(v) microphones that provide passive acoustic monitoring to listen for the sound of gas entry into the production tubing or the opening and closing of the gas lift valve;
(vi) ultrasound sensors that correlate changes in gas transmission with gas flows, bubbles, solids and other properties of flow along gas inlets;
(vii) Doppler shift sensors;
(viii) chemical sensors;
(ix) an imaging device; or
(x) combinations thereof.

Each sensor 188 sends electrical signals to its associated sensor communications node 182, wherein the signals are indicative of the value of a fluid flow parameter. The sensor communications nodes 182 include an electro-acoustic transducer 354 which converts electrical signals into acoustic energy. Elastic waves indicative of the fluid flow parameters are then transmitted from the sensor communications nodes 182, and up the wellbore 150 using the intermediate communications nodes 180, wherein acoustic signals are sent node-to-node.

The acoustic signals represent a packet of data that comprises (i) an acoustic waveform representing the fluid flow data, and (ii) the identification of the gas lift valve from whence the signals originated. The signals are delivered up to the topside communications node 184, and then to the receiver 170. The signals may then be processed and analyzed.

The telemetry system shown in FIGS. 1A and 1B improves gas-lifted well performance by using downhole sensors 188 to detect the location of lift-gas entry into the production tubing 140, and measure flow rates and other data along the production tubing 140. Permanent wireless sensor network nodes 182, powered by batteries 352 or other power sources, are installed in the wellbore 150 and are connected to the sensors 188. The gas lift surveillance data measured at each network sensor node 182 is transmitted wirelessly from node to node to the surface 101 by acoustic waves, and ultimately to the receiver 170.

It is observed that the communications nodes 180, 182 may be arranged to transmit wireless signals via other waves. These include radio waves, low frequency or inductive electromagnetic waves, and light. The telemetry network thus provides real-time gas-lift performance information. It is within the scope of the present technology that a portion of the wireless signals (e.g., up to one-half of the distance along the wellbore between the deepest communication node and the receiver 170) may be provided to the receiver 170 via these other waves, while the remaining portion (e.g., at least half of the distance along the wellbore between the deepest communication node and the receiver 170) of the wireless signals are provided to the receiver 170 by the acoustic waves.

It is noted that the operator will maintain a wellbore diagram that generally informs as to where the various sensor communications nodes 182 are located. In addition, the processor 172 will be programmed to associate the identification of the sensor communications node 182 transmitting a signal with the depth of the sensor reading(s). This is referred to in the telemetry industry as an address.

FIGS. 1A and 1B demonstrate the use of a wireless data telemetry system wherein communications nodes 180, 182 are placed along a string of tubing 140. The illustrative wellbore 150 is completed vertically. However, the wireless downhole telemetry system may also be employed in wells that are deviated or that are horizontally completed. Further, the telemetry system may employ intermediate communications nodes placed along the casing string of a wellbore.

Figure 2:
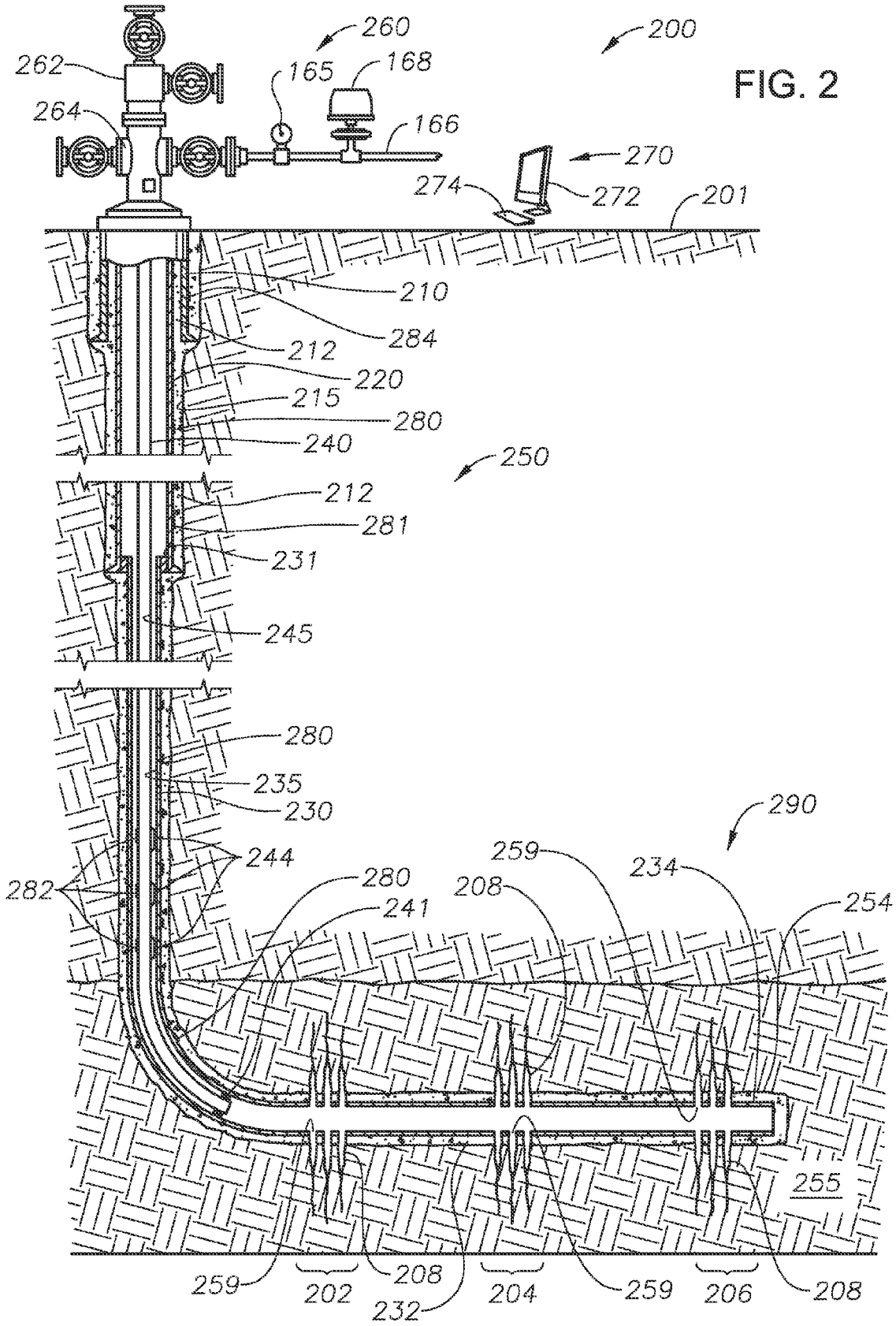
FIG. 2 is a cross-sectional view of another wellbore having been completed. The illustrative wellbore has been completed as a horizontal completion. A series of communications nodes is placed along the production tubing and the casing string as part of a telemetry system.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

The wellbore 250 has been completed horizontally using directional drilling. There are several advantages to directional drilling. These primarily include the ability to complete a wellbore along a substantially horizontal axis of a subsurface formation, thereby exposing a greater formation face. These also include the ability to penetrate into subsurface formations that are not located directly below the well head 260. This is particularly beneficial where an oil reservoir is located under an urban area or under a large body of water. Another benefit of directional drilling is the ability to group multiple well heads on a single platform, such as for offshore drilling. Finally, directional drilling enables multiple laterals and/or sidetracks to be drilled from a single wellbore in order to maximize reservoir exposure and recovery of hydrocarbons.

The well head 260 may be any arrangement of pipes or valves that receive reservoir fluids at the top of the well. The well head 260 of FIG. 2 is designed in accordance with the well head 160 of FIG. 1. The illustrative well head 260 includes a top valve 262 and a bottom valve 264.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of production equipment at the surface unless expressly noted in the claims.

Referring next to the wellbore 250, the wellbore 250 has been completed with a series of pipe strings referred to as casing. The casing is generally similar to that provided in the wellbore of FIG. 1A. In this respect, a surface casing 210, one or more strings of intermediate casing 220, and a production casing 230 are provided. The casing strings 210, 220, 230 are fixed in the wellbore by a cement sheath 212/232 residing within an annular region 215.

The surface casing 210 has an upper end in sealed connection with the lower valve 264. Similarly, the intermediate string of casing 220 is in sealed fluid communication with the upper valve 262. The production string 230 has a lower end 234 that extends to an end 254 of the wellbore 250. For this reason, the wellbore 250 is said to be completed as a cased-hole well. Those of ordinary skill in the art will understand that for production purposes, the liner 230 may be perforated after cementing to create fluid communication between a bore 235 of the liner 230 and the surrounding rock matrix making up the subsurface formation 255. In one aspect, the production string 230 is not a liner but is a casing string that extends back to the surface 201.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place and would not include subsurface communications nodes.

The wellbore 250 also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 241 is provided at a lower end of the production tubing 240 to seal off the annular region 235 between the tubing 240 and the surrounding production liner 230. However, the production tubing 240 may extend closer to the end 234 of the liner 230.

The wellbore 250 further includes one or more gas lift valves 244. The gas lift valves 244 reside along the production tubing 240 above the packer 241. The gas lift valves 244 receive gas injected into the annular region 235. The gas lift valves 244 then inject that gas into the bore 245 of the production tubing 240 for the purpose of reducing the density of the wellbore fluids, just as was done in wellbore 150 of FIGS. 1A and 1B.

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enables the operator to create fractures that are substantially transverse to the direction of the wellbore. However, the present inventions have equal utility in vertically completed wells or in multi-lateral deviated wells.

As with the well site 100 of FIG. 1A, the well site 200 of FIG. 2 includes a telemetry system that utilizes a series of novel communications nodes. This again is for the purpose of monitoring the flow of fluids in the production tubing 240 adjacent the gas lift valves 244. This enables the operator to optimize the efficiency of the gas lift system in the wellbore 250. In FIG. 2, communications nodes 280, 282 are placed along the wellbore 250, providing for the high speed transmission of wireless signals based on the in situ generation of acoustic waves.

The nodes first include a topside communications node 284. The topside communications node 284 is placed closest to the surface 201. The topside node 284 is configured to receive acoustic signals. In the arrangement of FIG. 2, the topside communications node 284 is attached to a top casing joint within the wellbore 250. However, the topside communications node 284 may optionally be attached to the well head 260 or an upper joint of production tubing 240. Any such arrangement is considered to be "along the wellbore."

In addition, the nodes include a plurality of intermediate communications nodes 280. Each of the intermediate communications nodes 280 is configured to receive and then relay acoustic signals along essentially the length of the wellbore 250. Preferably, the subsurface communications nodes 280 utilize electro-acoustic transceivers to receive and relay mechanical waves, although radio or other waves may be used for up to one-half of the distance from the deepest subsurface node 280 to the surface receiver 170.

The subsurface communications nodes 280 transmit signals as acoustic waves. The acoustic waves are preferably at a frequency of between about 50 kHz and 500 kHz, and more preferably between about 75 kHz and 250 kHz. The signals are delivered up to the topside communications node 284, in node-to-node arrangement.

The signals originate with sensors located along the wellbore 250. Sensors are not shown in FIG. 2; however, it is understood that they operate as described above for sensor 188 shown in FIG. 1B. Each sensor is associated with a sensor communications node 282, which in turn resides adjacent to a gas lift valve 244. As describe above, an electro-acoustic transducer 354 within the sensor communications node 282 converts the signals from the sensors 188 into an acoustic signal. The acoustic signal is then transmitted to communications nodes 280 along the production tubing 240 by means of a transceiver within the nodes 280, 282.

The acoustic signal represents a packet of data. The packet of data will first include an identifier for the sensor communications node 282 that originally transmitted the signal. The packet of data will also include a waveform indicative of the sensor readings from the sensors.

The well site 200 of FIG. 2 shows a receiver 270. The receiver 270 comprises a processor 272 that receives signals sent from the topside communications node 284. The processor 272 may include discrete logic, any of various integrated circuit logic types, or a microprocessor. The receiver 270 may include a screen and a keyboard 274 (either as a keypad or as part of a touch screen). The receiver 270 may also be an embedded controller with neither a screen nor a keyboard which communicates with a remote computer via cellular modem or telephone lines.

The signals may be received by the processor 272 through a wire (not shown) such as a co-axial cable, a fiber optic cable, a USB cable, or other electrical or optical communications wire. Alternatively, the receiver 270 may receive the final signals from the topside node 282 wirelessly through a modem or transceiver. The receiver 270 preferably receives electrical signals via a so-called Class I, Div. 1 conduit, that is, a wiring system or circuitry that is considered acceptably safe in an explosive environment.

FIGS. 1A and 2 present illustrative wellbores 150, 250 that may receive a downhole telemetry system using acoustic transducers. In each of FIGS. 1A and 2, the communications nodes 180, 280 are specially designed to withstand the same corrosion and environmental conditions (high temperature, high pressure) of a wellbore 150 or 250 as the casing, drill string, or production tubing. To do so, it is preferred that the communications nodes 180, 280 include steel housings for holding the electronics. In one aspect, the steel material is a corrosion resistant alloy.

Figure 4B:
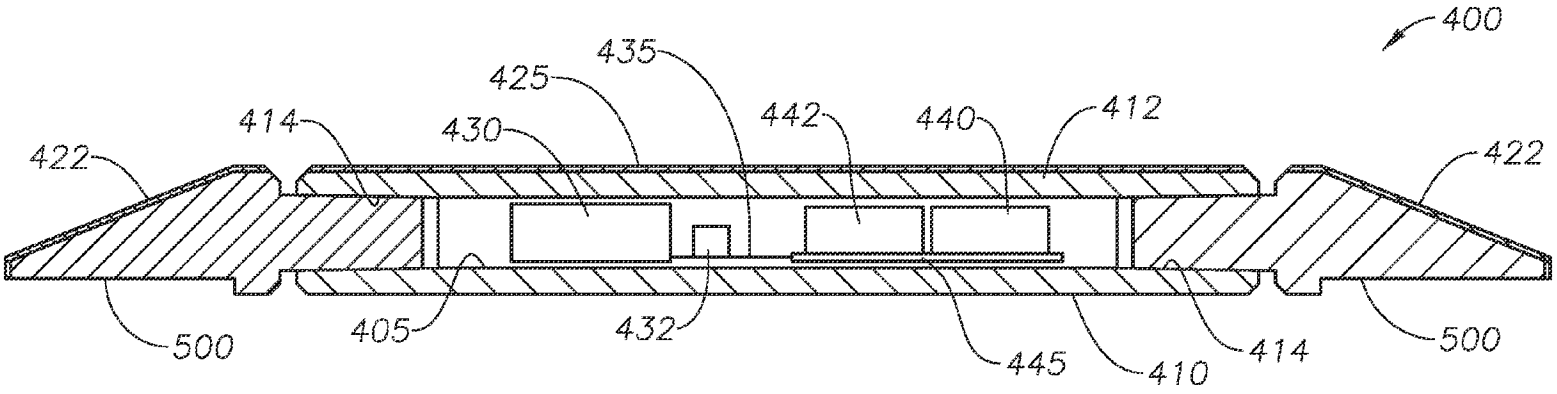
FIG. 4B is a cross-sectional view of the communications node of FIG. 4A. The view is taken along the longitudinal axis of the node. Here, a sensor is provided within the communications node.
Figure 4C:
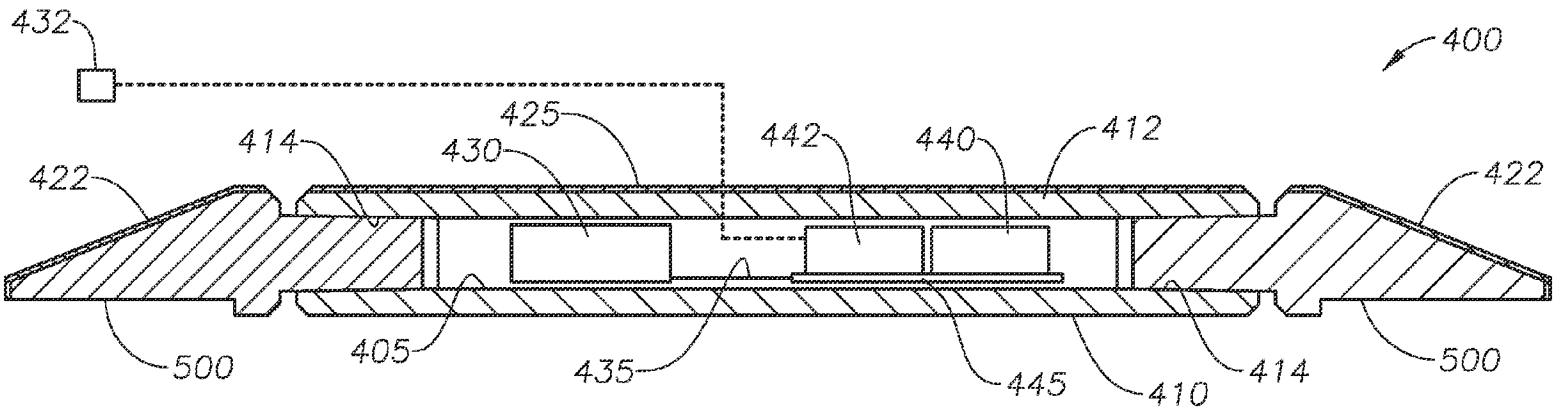
FIG. 4C is another cross-sectional view of the communications node of FIG. 4A. The view is again taken along the longitudinal axis of the node. Here, a sensor resides along the wellbore external to the communications node.
Figure 4A:
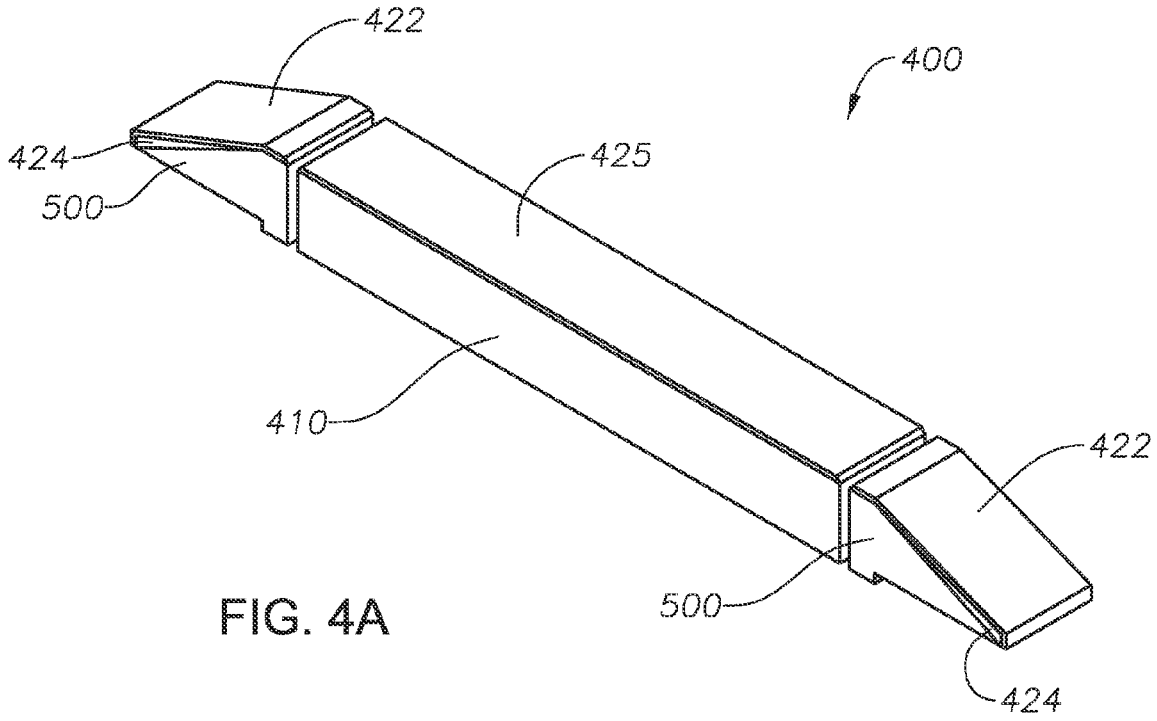
FIG. 4A is a perspective view of a communications node as may be used in the wireless data transmission system of the present invention, in an alternate embodiment.

FIG. 4A is a perspective view of a communications node 400 as may be used in the wireless data transmission systems of FIG. 1A or FIG. 2 (or other wellbore), in one embodiment. The communications node 400 is designed to provide data communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A and 4B, together.

The communications node 400 first includes a fluid-sealed housing 410. The housing 410 is designed to be attached to an outer wall of a joint of wellbore pipe, such as the pipe joint 300 of FIG. 3. Where the wellbore pipe is a carbon steel pipe joint such as drill pipe, casing or liner, the housing 410 is preferably fabricated from carbon steel. This metallurgical match avoids galvanic corrosion at the coupling.

The housing 410 includes an outer wall 412. The wall 412 is dimensioned to protect internal electronics for the communications node 400 from wellbore fluids and pressure. In one aspect, the wall 412 is about 0.2 inches (0.51 cm) in thickness. The housing 410 optionally also has a protective outer layer 425. The protective outer layer 425 resides external to the wall 412 and provides an additional thin layer of protection for the electronics.

A bore 405 is formed within the wall 412. The bore 405 houses the electronics, shown in FIG. 4B as a battery 430, a power supply wire 435, a transceiver 440, and a circuit board 445. The circuit board 445 will preferably include a micro-processor or control logic associated with the transceiver 440 for digitizing acoustic signals. An electro-acoustic transducer 442 is provided to convert electrical energy to acoustical energy (or vice-versa) and is coupled with outer wall 412 on the side attached to the tubular body.

The transducer 442 is in electrical communication with a sensor 432. The sensors measure may be used to infer fluid composition along a wellbore. The sensor may be, for example, (i) a temperature sensor, (ii) a fluid identification sensor, (iii) an amp meters or volt meters that measures an electrical current that is passed along a body of a subsurface communications node, (iv) an electrical device that measures a capacitance of fluid, (v) a microphone, (vi) a device for measuring fluid density, (vii) a flow rate measurement device, or (viii) a device for measuring rheology of fluid density in proximity to a corresponding gas lift valve 244. In this instance, the communications node 400 is configured to receive and relay acoustic signals indicative of readings taken by the fluid measurement sensors up to the surface 201.

Each sensor 432 sends signals to its associated transceiver 440 through a short electrical wire 435 or through the printed circuit board 435. Signals from the sensor 432 are converted into acoustic signals by the transducer 442 and are sent by the transceiver 440 as part of the packet of information.

It is noted that in FIG. 4B, the sensor 432 resides within the housing 410 of the communications node 400. However, as noted the sensor 432 may reside external to the communications node 400, such as above or below the node 400 along the wellbore. In FIG. 4C, a dashed line is provided showing an extended connection between the sensor 432 and the electro-acoustic transducer 442.

The transceiver 440 may receive an acoustic telemetry signal from a preceding node. In one preferred embodiment, the acoustic telemetry data transfer is accomplished using multiple frequency shift keying (MFSK). Any extraneous noise in the signal is moderated by using known conventional analog and/or digital signal processing methods. This noise removal and signal enhancement may involve conveying the acoustic signal through a signal conditioning circuit using, for example, a bandpass filter.

In one embodiment, an electrical signal is delivered to an electromechanical transducer, such as through a driver circuit. In a preferred embodiment, the transducer is the same electro-acoustic transducer that originally received the MFSK data. The signal generated by the electro-acoustic transducer is provided to a corresponding transceiver, which then transmits the signals acoustically. Acoustic signals are passed through the housing 410 to the tubular body (such as production tubing 240), and propagate along the tubular body to other communication nodes. The re-transmitted signal represents the same sensor data originally transmitted by sensor communications node 284. In one aspect, the acoustic signal is generated and received by a magnetostrictive transducer comprising a coil wrapped around a core as the transceiver. In another aspect, the acoustic signal is generated and received by a piezo-electric ceramic transducer. In either case, the electrically encoded data are transformed into a sonic wave that is carried through the wall of the tubular body in the wellbore.

In another embodiment, ultrasound telemetry signals are used to correlate changes in their transmission with gas flows, bubbles, solids and other properties of flows above, below and at gas inlets. In other embodiments, flow changes are measured using ultrasound, Doppler shift, chemical sensors, and imaging approaches to measuring flows.

Each transceiver 440 is associated with a specific joint of pipe, a section of a joint, or a span of "N" joints, i.e., 2 to 20 joints. That associated joint or section of pipe, in turn, has a known location or depth along the wellbore. The acoustic wave as originally transmitted from the transceiver 440 will represent a packet of information. The packet will include an identification code that tells a receiver (such as receiver 270 in FIG. 2) where the signal originated, that is, which communications node 400 it came from. In addition, the packet will include an amplitude value originally recorded by the communications node 400 for its associated joint of pipe.

When the signal reaches the receiver at the surface 101 or 201, the signal is processed. This involves identifying which communications node the signal originated from, and then determining the location of that communications node along the wellbore. This may further involve comparing the original amplitude value with a baseline value. The baseline value represents an anticipated temperature indicative of the presence of a wellbore fluid.

The communications node 400 also optionally includes a shoe 500. More specifically, the node 400 includes a pair of shoes 500 disposed at opposing ends of the wall 412. Each of the shoes 500 provides a beveled face that helps prevent the node 400 from hanging up on an external tubular body or the surrounding earth formation, as the case may be, during run-in or pull-out. The shoes 500 may have a protective outer layer 422 and an optional cushioning material 424 under the outer layer 422.

Figure 5A:
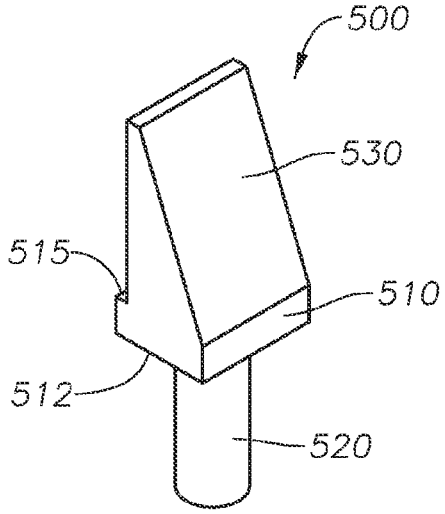
FIGS. 5A and 5B are perspective views of a shoe as may be used on opposing ends of the communications node of FIG. 4A, in one embodiment.
Figure 5B:
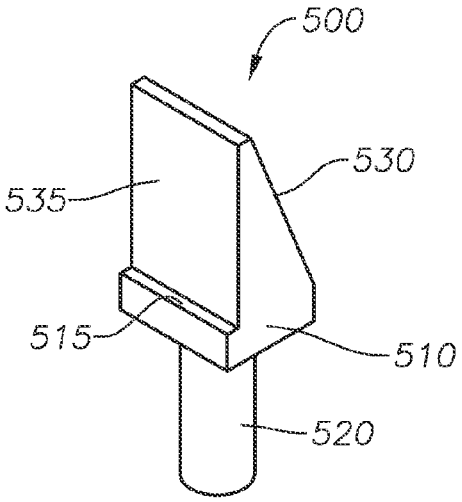

FIGS. 5A and 5B are perspective views of an illustrative shoe 500 as may be used on an end of the communications node 400 of FIG. 4A, in one embodiment. In FIG. 5A, the leading edge or front of the shoe 500 is seen, while in FIG. 4B the back of the shoe 500 is seen.

The shoe 500 first includes a body 510. The body 510 includes a flat under-surface 512 that butts up against opposing ends of the wall 412 of the communications node 400.

Extending from the under-surface 512 is a stem 520. The illustrative stem 520 is circular in profile. The stem 520 is dimensioned to be received within opposing recesses 414 of the wall 412 of the node 400.

Extending in an opposing direction from the body 510 is a beveled surface 530. As noted, the beveled surface 530 is designed to prevent the communications node 400 from hanging up on an object during run-in into a wellbore.

Behind the beveled surface 530 is a flat (or slightly arcuate) surface 535. The surface 535 is configured to extend along the drill string 160 (or other tubular body) when the communications node 400 is attached along the tubular body. In one aspect, the shoe 500 includes an optional shoulder 515. The shoulder 515 creates a clearance between the flat surface 535 and the tubular body opposite the stem 520.

In one arrangement, the communications nodes 400 with the shoes 500 are welded onto an outer surface of the tubular body, such as wall 310 of the pipe joint 300. More specifically, the body 410 of the respective communications nodes 400 are welded onto the wall of a joint of casing. In some cases, it may not be feasible or desirable to pre-weld the communications nodes 400 onto pipe joints before delivery to a well site. Further still, welding may degrade the tubular integrity or damage electronics in the housing 410. Therefore, it is desirable to utilize a clamping system that allows a drilling or service company to mechanically connect/disconnect the communications nodes 400 along a tubular body as the tubular body is being run into a wellbore.

Figure 6:
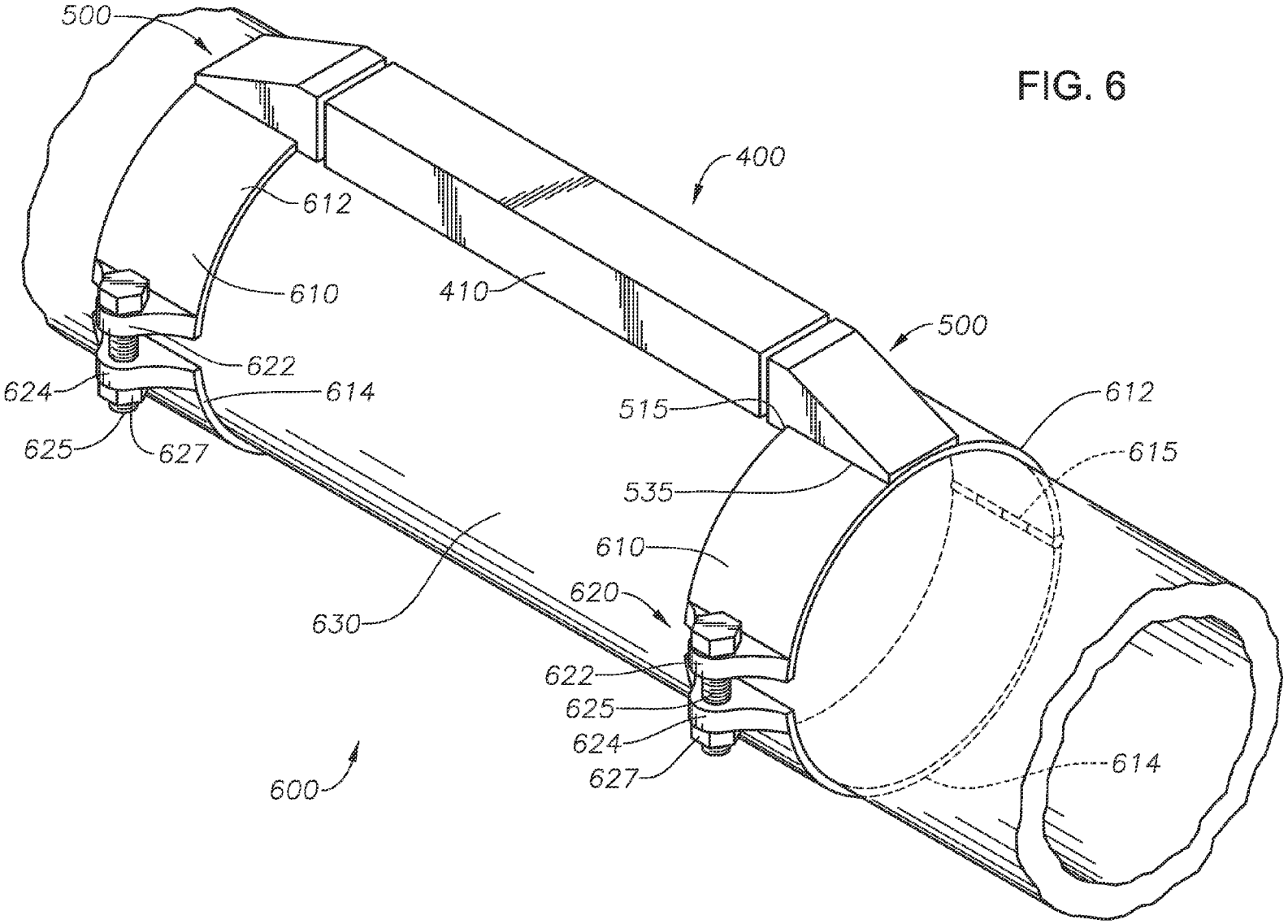
FIG. 6 is a perspective view of a communications node system as may be used in the methods of the present invention, in one embodiment. The communications node system utilizes a pair of clamps for connecting a subsurface communications node onto a tubular body.

FIG. 6 is a perspective view of a communications node system 600 as may be used for methods of the present invention, in one embodiment. The communications node system 600 utilizes a pair of clamps 610 for mechanically connecting a communications node 400 onto a tubular body 630 such as a joint of casing or a joint of production tubing, such as the tubing 240 of FIG. 2. In any instance, the wall 412 of the communications node 400 is fabricated from a steel material having a resonance frequency compatible with the resonance frequency of the tubular body 630. Stated another way, the mechanical resonance of the wall 412 is at a frequency contained within the frequency band used for telemetry.

In one aspect, the communications node 400 may be, for example, 12 to 16 inches (0.30 to 0.41 meters) in length as it resides along the tubular body 630. Specifically, the housing 410 of the communications node may be 8 to 10 inches (0.20 to 0.25 meters) in length, and each opposing shoe 500 may be 2 to 5 inches (0.05 to 0.13 meters) in length. Further, the communications node 400 may be, for example 1 inch in width and 1 inch in height. The base 410 of the communications node 400 may have a concave profile that generally matches the radius of the tubular body 630.

A further description of the communications node system 600 and the clamps 610 is provided in WIPO Patent Publ. No. WO 2014/100272 (noted above). That description is incorporated by reference herein to avoid repetition.

In addition to the telemetry networks described above in connection with the wellbores 150, 250, methods of monitoring fluid flow within production tubing along gas lift valves are provided herein. The methods of the present invention can be presented in flow chart form. The method preferably employs the communications node 400 and the communications node system 600 of FIG. 6.

Figure 7:
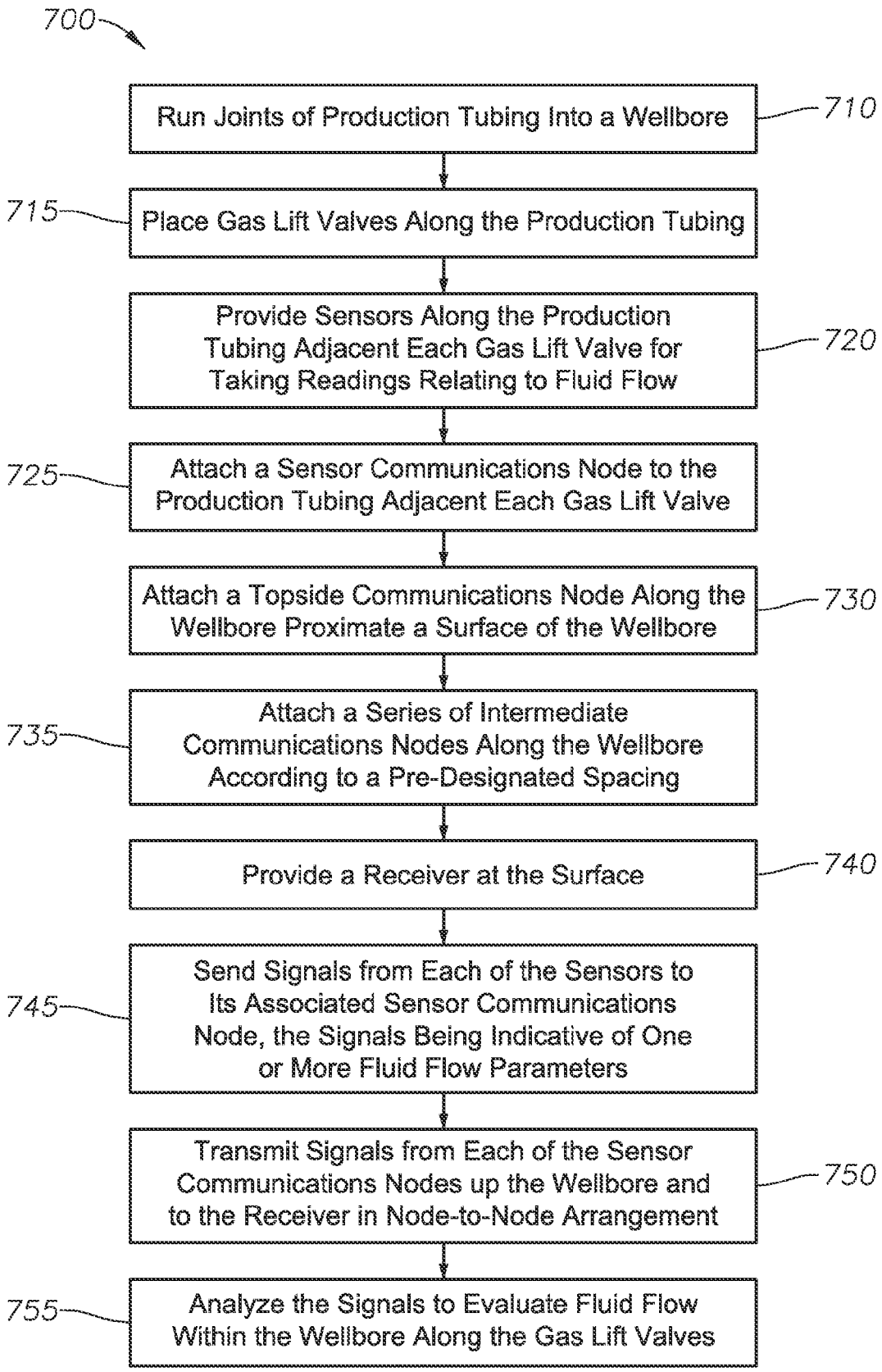
FIG. 7 is a flowchart demonstrating steps of a method for monitoring fluid flow along a wellbore in accordance with the present invention, in one embodiment.

FIG. 7 provides a flow chart for a method 700 of monitoring fluid flow within a wellbore. The method 700 uses a plurality of communications nodes situated along pipe strings within the wellbore to accomplish a wireless transmission of data. The data represents signals that indicate the presence or nature of fluid flow through the production tubing adjacent gas lift valves.

The method 700 first includes running joints of production tubing into the wellbore. This is shown at Box 710. The joints are connected by threaded couplings to form a pipe string. The joints of pipe are fabricated from a steel material suitable for conducting an acoustical signal. The joints may be part of a vertical pipe string, a lateral pipe string, or a multi-lateral pipe string.

The wellbore is completed for the purpose of conducting hydrocarbon recovery operations. Accordingly, the method also includes placing one or more gas lift valves along the pipe string. This is indicated at Box 715. Preferably, the gas lift valves are located in side pocket mandrels.

The method 700 also provides for placing at least one sensor along the wellbore adjacent or otherwise associated with each of the one or more gas lift valves. This is provided at Box 720. Each sensor is designed to measure a parameter indicative of fluid flow within the wellbore. The sensors may be any of the sensors listed herein.

The method 700 next includes attaching one or more sensor communications nodes to the pipe string. This is seen at Box 725. The sensor communications nodes are attached adjacent a corresponding gas lift valve. Each sensor communications node is in electrical communication with an associated sensor, and is configured to receive signals from the associated sensor indicative of fluid flow.

In operation, the valves are designed to open and close on their own based on the pressure in the annulus around the side pocket mandrels. A sensor will detect when a valve opens to direct fluid into the production tubing. If the gas is entering through any valve other than the lowermost valve, or if two or more valves are open at the same time, then the system is not functioning optimally.

The method 700 also provides for attaching a topside communications node to the pipe string proximate the surface. This step is shown at Box 730. The topside communications node is the uppermost communications node along the wellbore. In one aspect, the topside communications node is attached to an uppermost joint of production tubing or surface casing along the wellbore. This may be, for example, in a cellar. Alternatively, and more preferably, the topside communications node is connected to the well head or to a tubular body immediately downstream from the wellhead and above grade. The topside communications node transmits signals from an uppermost intermediate communications node to the surface.

The method 700 additionally includes attaching a series of intermediate communications nodes along the wellbore. This is given at Box 735. Preferably, the intermediate communications nodes are attached to the joints of production tubing according to a pre-designated spacing. In one aspect, each joint of pipe receives at least one communications node. Preferably, each of the subsurface communications nodes is attached to a joint of pipe by one or more clamps. In this instance, the step of attaching the communications nodes to the joints of pipe comprises clamping the communications nodes to an outer surface of the joints of pipe. Alternatively, an adhesive material or welding may be used for the attaching step 735.

The intermediate communications nodes are configured to transmit acoustic waves, or waveforms, from the sensor communications nodes, node-to-node up the wellbore and to the topside communications node. Each intermediate communications node includes a transceiver that receives an acoustic signal from a previous communications node, and then transmits or relays that acoustic signal to a next communications node, in node-to-node arrangement. In one aspect, the communications nodes transmit data as mechanical waves at a rate exceeding about 50 bps. The intermediate communications nodes are configured as described above.

The method 700 next includes providing a receiver. This is shown at Box 740. The receiver is placed at the surface. The receiver has a processor that processes signals received from the topside communications node, such as through the use of firmware and/or software. The receiver preferably receives electrical or optical signals via a so-called "Class I, Division I" conduit, meaning a conduit (as defined by NFPA 497 and API 500) for operation in an electrically classified area. Alternatively, data may be transferred from the topside communications node to the receiver via an electromagnetic wireless connection or through a radio signal or other wireless protocol. The processor processes the signals to identify which signals correlate to which sensor communications node that originated the signal. In this way, the operator will understand the gas lift valve at which the readings are being made.

In operation, each sensor sends signals to its associated sensor communications node. This is indicated at Box 745. In one aspect, each of the sensors resides within the housing of an associated sensor communications node. An electro-acoustic transducer within the associated sensor communications node converts signals from the sensors into acoustic signals. In another aspect, each of the one or more sensors resides adjacent to the housing of its associated sensor communications node. Each of the one or more sensors is in electrical communication with its corresponding sensor communications node. The electro-acoustic transducer within the associated sensor communications node converts signals from the sensors into acoustic signals for the associated transceivers. The sensor communications nodes receive electrical signals from the sensors, and then generate an acoustic signal using an electro-acoustic transducer. The acoustic signal corresponds to readings sensed by the respective sensors. The transceivers in the subsurface communications nodes then transmit the acoustic signals up the wellbore, node-to-node.

The sensor communications nodes generate a signal that corresponds to readings sensed by the respective sensors. This is provided at Box 750. The signals are acoustic signals that have a resonance amplitude. Electro-acoustic transceivers in the subsurface communications nodes transmit acoustic signals up the wellbore representative of fluid flow, fluid identification, pressure, and/or temperature readings, node-to-node. The topside communications node then transmits signals from an uppermost subsurface communications node to a receiver at the surface.

In one aspect, piezo wafers or other piezoelectric elements are used to receive and transmit acoustic signals. In another aspect, multiple stacks of piezoelectric crystals or other magnetostrictive devices are used. Signals are created by applying electrical signals of an appropriate frequency across one or more piezoelectric crystals, causing them to vibrate at a rate corresponding to the frequency of the desired acoustic signal.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node. In this way, if one node fails, it can be bypassed by transmitting data directly between its nearest neighbors above or below. In one example, the tones are evenly spaced in period within a frequency band from about 50 kHz to 500 kHz. More preferably, the tones are evenly spaced in frequency within a frequency band from about 100 kHz to 125 kHz.

Preferably, the nodes employ a "frequency hopping" method where the last transmitted tone is not immediately re-used. This prevents extended reverberation from being mistaken for a second transmitted tone at the same frequency. For example, 17 tones are utilized for representing data in an MFSK modulation scheme; however, the last-used tone is excluded so that only 16 tones are actually available for selection at any time.

The communications nodes will transmit data as mechanical waves at a rate exceeding about 50 bps.

The transceiver in each sensor communications node is configured to send its acoustic signals indicative of fluid flow data (i) according to a pre-programmed schedule, (ii) in the event that a condition of gas lift valve failure is identified, or (iii) only when interrogated by a user at the surface.

The method 700 also includes analyzing the signals received from the communications nodes. This is seen at Box 755. The signals are analyzed to determine the efficiency of the gas lift valve system along the production tubing.

In the method 700, each of the communications nodes has an independent power source. The independent power source may be, for example, batteries or a fuel cell. Having a power source that resides within the housing of the communications nodes reduces the need for passing electrical connections through the housing, which could compromise fluid isolation. In addition, each of the intermediate communications nodes has a transducer and associated transceiver.

Preferably, a signal may be sent from the surface to the communications nodes to switch them into a low-power, or "sleep," mode. This preserves battery life when real-time downhole data is not needed. The communications nodes may be turned back on to generate a flow profile along selected zones of the wellbore. In one aspect, the communications nodes are turned on prior to beginning an acid stimulation treatment. The sensors downhole will measure the flow rate of the stimulation fluid moving past each sensor communications node and out into the formation. In this way, real time information on the outflow profile is gathered. In a similar way, outflow data may be gathered where the wellbore is used as an injection well for water flooding or other secondary recovery operations.

A separate method of evaluating a gas lift system in a wellbore is provided herein. The method relies upon an acoustic telemetry system for transmitting signals indicative of fluid flow adjacent gas lift valves along production tubing.

The method first includes receiving signals from a wellbore. Each signal defines a packet of information having (i) an identifier for a subsurface communications node originally transmitting the signal, and (ii) an acoustic waveform for the subsurface communications node originally transmitting the signal. The acoustic waveform is indicative of a fluid flow condition within a string of production tubing adjacent a gas lift valve. The fluid flow condition may be any of (i) fluid flow rate, (ii) sound, (iii) pressure, (iv) temperature, (v) fluid density, (vi) fluid phase, or (vii) combinations thereof.

The method also includes correlating communications nodes to their respective gas lift valves in the wellbore. In addition, the method comprises processing the amplitude values to evaluate fluid flow conditions in the production tubing. Stated another way, the method includes analyzing the waveforms to evaluate fluid flow conditions within the wellbore adjacent each gas lift valve.

In this method, the subsurface communications nodes may be constructed in accordance with communications node 350 of FIG. 3, communications node 400 of FIG. 4, or other arrangement for acoustic transmission of data. Preferably, each of the subsurface communications nodes is attached to an outer wall of the tubing or the casing string according to a pre-designated spacing. The subsurface communications nodes are configured to communicate by acoustic signals transmitted through the wall of a tubular body, such as the production tubing.

The fluid flow conditions are detected by sensors residing along the production tubing. The sensors may be any of:

(i) fluid velocity measurement devices residing inside of the production tubing;
(ii) temperature sensors that measure temperature of fluids flowing inside of the production tubing;
(iii) pressure sensors that measure pressure inside of the production tubing, or pressure drop across a gas lift valve;
(iv) fluid density sensors that measure the density of fluids inside of the production tubing;
(v) microphones that provide passive acoustic monitoring to listen for the sound of gas entry into the production tubing or the opening and closing of the gas lift valve;
(vi) ultrasound sensors that correlate changes in gas transmission with gas flows, bubbles, solids and other properties of flow along gas inlets;
(vii) Doppler shift sensors;
(viii) chemical sensors;
(ix) an imaging device; and
(x) combinations thereof to produce direct or "virtual" sensors of gas lift valve operation and related flows of gas, liquids and solids.

Electrical, electro-magnetic or fiber optic signals are sent from the sensors to selected subsurface communications nodes. Electro-acoustic transducers within the sensor communications nodes, in turn, send acoustic signals to a transceiver, which then transmits the signals acoustically. The transceivers in the selected subsurface communications nodes transmit acoustic signals up the wellbore representative of the fluid flow readings, node-to-node. Signals are transmitted from the sensor communications nodes to a receiver at a surface through a series of subsurface communications nodes, with each of the subsurface communications nodes being attached to an outer wall of the production tubing or casing according to a pre-designated spacing.

The methods described above may be practiced either before or after a wellbore has been completed. For example, after a portion of a wellbore has been drilled, a casing crew may be brought in to run casing into the wellbore. The casing crew will be trained in how to install subsurface communications nodes onto an outer wall of the production tubing and/or joints of casing. The communications nodes are clamped onto the pipe joints during run-in to form a wireless acoustic telemetry system. After all of the casing strings are in place and the production tubing is in place, the communications nodes are activated. Signals are delivered from fluid flow sensors at the depth of gas lift valves to sensor communications nodes. Those nodes transmit the signals as acoustic signals via a plurality of intermediate communications nodes and a topside communications node, node-to-node, up to a receiver at the surface. The acoustic signals are packets of information that identify the sensor communications node sending the original waveform, and the fluid flow data associated with the gas lift valve.

Each node contains a piezoelectric device to allow acoustic communication to nearby nodes. Each node is powered by an internal battery. The nodes may have memory chips to store data.

The lowest nodes are installed on the outside of production tubing adjacent the gas lift mandrels. Lift gas is injected down the annulus between the production tubing and the casing, and enters the wellbore through valves located in the gas lift mandrels. When performing optimally, the lift gas enters the wellbore only through the lowermost gas lift valve. The sensor nodes record, for example, the local temperature and/or pressure, and passively listen for the acoustic signature of gas flowing into the production tubing through the valves, and send a message to the surface when lift gas entry is detected at a sub optimal location. Upon request from a user at the surface, a node at a lift gas entry point can transmit pressure, temperature, sound, and/or lift gas flow rate data stored in its memory.

In an alternative embodiment, the subsurface communications nodes are installed on the inside of production tubing with sensors placed inside each gas lift mandrel. Alternatively, the subsurface communications nodes are installed on the outside of the production tubing, but the sensor communications nodes are placed inside the production tubing adjacent the respective gas lift valves. The associated sensors may be placed inside the side pocket mandrels to communicate with the sensor communications nodes wirelessly.

In one aspect, the sensor communications nodes may be specially queried using a logging device conveyed across the length of the wellbore on a wireline. The wireline may be an electric line that sends data from the sensor communications nodes up the wellbore. Alternatively, the wireline may be a slick line, coiled tubing or jointed working string that retrieves the logging tool, whereupon data is uploaded from the logging tool to a processor when the device is returned to surface.

For existing gas-lifted wells where it is undesirable to pull out the production tubing, the wireless sensor communications nodes may be run into the hole on a tool string and mounted on the inside of the tubing or on the inside of the side pocket mandrels. Alternatively, the wireless sensor nodes may be built directly onto the gas-lift valves and inserted into side pocket mandrels using a tool string, or the wireless sensor nodes may be mounted onto a rod string which is run into the well and hung just below the wellhead.

The downhole wireless network nodes described above form an intelligent, autonomous surveillance system. The network may be programmed to process/analyze the fluid flow data that the sensor communications nodes collect, and only transmit processed results to surface when necessary. For example, if lift gas enters through the wrong gas lift valve, the event could be detected by analysis of downhole sound, pressure, or other data. Rather than transmit the raw data to surface for analysis, the downhole wireless sensor communications could be programmed to do the data analysis using their onboard microprocessor, and only transmit a message to the surface if a sensor node has detected lift gas entry at a sub-optimal location. The ability to do on-board data processing preserves network lifetime by reducing the number of communications to surface.

In any instance, acoustic transducers may be used to determine the types of fluids flowing inside the production tubing and to measure the flow rates of the fluids. Alternatively or in addition, a series of pressure sensors are used to measure the flow rate of fluids flowing inside the production tubing or in an annulus. Alternatively or in addition, a series of temperature sensors are used to measure the flow rate of fluids flowing inside the production tubing or in an annulus.

As can be seen, a novel downhole telemetry system is provided, as well as a novel method for the wireless transmission of information using a plurality of data transmission nodes for monitoring the efficiency of gas lift valves. The inventions improve well performance by using attachable sensors to measure flow rates and other fluid flow data along the gas lift valves. While it will be apparent that the inventions herein described are well calculated to achieve the benefits and advantages set forth above, it will be appreciated that the inventions are susceptible to modification, variation and change without departing from the spirit thereof.

What is claimed is:

1. An electro-acoustic telemetry system for monitoring fluid flow in a wellbore, the wellbore penetrating into a subsurface formation, and the telemetry system comprising:

a production tubing disposed in the wellbore, the production tubing being comprised of threadedly-connected pipe joints;

one or more gas lift valves placed along the production tubing;

at least one sensor disposed along the production tubing adjacent each of the one or more gas lift valves, each sensor designed to measure a parameter indicative of fluid flow within the production tubing adjacent the one or more gas lift valves;

one or more sensor communications nodes associated with and in electrical communication with one of the at least one sensors and configured to receive signals from the associated sensor indicative of fluid flow;

a topside communications node placed along the wellbore proximate a surface;

a plurality of intermediate communications nodes spaced along the wellbore and attached to a pipe string, the intermediate communications nodes including a transceiver in acoustic contact with the production tubing and configured to transmit acoustic waves from node-to-node along the wellbore using the production tubing as a transmission medium for the acoustic waves from the one or more sensor communications nodes to the topside communications node; and wherein each of the intermediate communications nodes comprises:

a sealed housing;

an electro-acoustic transducer and associated transceiver residing within the housing, with the transceiver being designed to relay signals from node-to-node up the wellbore, with each signal representing a packet of information that comprises an acoustic waveform representing fluid flow data; and an independent power source residing within the housing providing power to the transceiver.

2. The electro-acoustic telemetry system of claim 1, wherein the surface is an earth surface, or a production platform offshore.

3. The electro-acoustic telemetry system of claim 2, wherein:

the one or more sensors for measuring a parameter indicative of fluid flow are any of:

(i) fluid velocity measurement devices residing inside of the production tubing;

(ii) temperature sensors that measure temperature of fluids flowing inside of the production tubing;

(iii) pressure sensors that measure pressure inside of the production tubing, or pressure drop across a gas lift valve;

(iv) fluid density sensors that measure the density of fluids inside of the production tubing;

(v) microphones that provide passive acoustic monitoring to listen for the sound of gas entry into the production tubing or the opening and closing of the gas lift valve;

(vi) ultrasound sensors that correlate changes in gas transmission with gas flows, bubbles, solids and other properties of flow along gas inlets;

(vii) Doppler shift sensors;

(viii) chemical sensors;

(ix) an imaging device; and (x) combinations thereof; and each of the one or more sensor communications nodes is configured to receive signals from the associated sensor, and relay acoustic signals indicative of readings taken by the sensors.

4. The electro-acoustic telemetry system of claim 3, wherein:

the one or more gas lift valves comprises at least two gas lift valves;

the packet of information in each signal relayed by the transceivers further comprises an identifier for the sensor communications node that originally transmitted the signal; and the system further comprises a receiver at the surface configured to receive signals from the topside communications node.

5. The electro-acoustic telemetry system of claim 4, wherein:

the wellbore comprises a production packer sealing an annulus between the production tubing and a surrounding string of casing;

each of the at least two gas lift valves resides above the production packer; and the pipe string is the string of production tubing.

6. The electro-acoustic telemetry system of claim 5, wherein the intermediate communications nodes are spaced apart such that each intermediate communications node resides on its own joint of production tubing.

7. The electro-acoustic telemetry system of claim 4, wherein:

the intermediate communications nodes are spaced at about 10 to 1,000 foot (3.0 to 304.8 meter) intervals; and the transceivers transmit data in acoustic form at a rate exceeding about 50 bps.

8. The electro-acoustic telemetry system of claim 4, wherein each of the transceivers is designed to receive acoustic waves at a first frequency, and then transmit the acoustic waves at a second different frequency up the wellbore to a next communications node.

9. The electro-acoustic system of claim 4, wherein a frequency band for the acoustic wave transmission by the transceivers is about 25 KHz wide.

10. The electro-acoustic system of claim 4, wherein a frequency band for the acoustic wave transmission by the transceivers operates from about 100 kHz to 125 kHz.

11. The electro-acoustic telemetry system of claim 4, wherein the acoustic waves provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

12. The electro-acoustic system of claim 4, wherein:
- each of the one or more sensors resides within the housing of its associated sensor communications node; and
- an electro-acoustic transducer within the associated sensor communications node converts signals from the sensor into acoustic signals for the associated transceiver.

13. The electro-acoustic system of claim 4, wherein:
- each of the one or more sensors resides adjacent but external to the housing of an associated sensor communications node; and
- the electro-acoustic transducer within the associated sensor communications node converts signals from the sensor into acoustic signals for the associated transceiver.

14. The electro-acoustic telemetry system of claim 1, wherein:
- a well head is placed above the wellbore; and
- the topside communications node is placed (i) on an outer surface of the well head, or (ii) on the outer surface of an uppermost joint of the production tubing.

15. The electro-acoustic telemetry system of claim 1, wherein the intermediate communications nodes are attached to an outer wall of the production tubing by (i) an adhesive material, (ii) by welding, or (iii) by one or more mechanical fasteners.

16. The electro-acoustic telemetry system of claim 1, wherein:
- each of the intermediate communications nodes is attached to the production tubing by one or more clamps; and
- each of the one or more clamps comprises:
  - a first arcuate section;
  - a second arcuate section;
  - a hinge for pivotally connecting the first and second arcuate sections; and
  - a fastening mechanism for securing the first and second arcuate sections around an outer surface of a joint of the production tubing.

17. The electro-acoustic telemetry system of claim 4, wherein each of the sensor communications nodes also comprises an electro-acoustic transducer and associated transceiver residing within a housing, with the transceiver being designed to relay signals from node-to-node up the wellbore representing the fluid flow data.

18. The electro-acoustic telemetry system of claim 4, wherein at least one intermediate communications node resides between adjacent sensor communications nodes.

19. The electro-acoustic telemetry system of claim 4, wherein each of the at least two gas lift valves resides in a side pocket mandrel.

20. The electro-acoustic telemetry system of claim 4, wherein each of the sensors and associated sensor communications nodes resides below or within a corresponding side pocket mandrel.

21. The electro-acoustic telemetry system of claim 17, wherein the transceiver in each sensor communications node is configured to send its acoustic signals indicative of fluid flow data (i) according to a pre-programmed schedule, (ii) in the event that a condition of gas lift valve failure is identified, or (iii) only when interrogated by a user at the surface.

22. A method of monitoring fluid flow along a wellbore, the wellbore penetrating into a subsurface formation, and the method comprising:
- running joints of production tubing into the wellbore to form a pipe string;
- placing one or more gas lift valves along the pipe string;
- placing at least one sensor along the pipe string adjacent each of the one or more gas lift valves, each sensor designed to measure a parameter indicative of fluid flow within the wellbore;
- attaching a sensor communications node to the pipe string adjacent each gas lift valve, each sensor communications node being in electrical communication with an associated sensor and configured to receive signals from the associated sensor indicative of fluid flow;
- attaching a topside communications node to the pipe string proximate a surface of the wellbore; and
- attaching a series of intermediate communications nodes to the pipe string according to a pre-designated spacing, the intermediate communications nodes in electrical communication with one of the at least one sensors configured to acoustically transmit acoustic waves from the sensor communications nodes to the topside communications node; and
- wherein each of the intermediate communications nodes comprises:
  - a sealed housing;
  - an electro-acoustic transducer and associated transceiver residing within the housing configured to relay signals from node-to-node up the wellbore, with each signal representing a packet of information that comprises an acoustic waveform representing fluid flow data; and
  - an independent power source also residing within the housing for providing power to the transceiver.

23. The method of claim 22, further comprising:
- sending signals from the one or more sensors to the associated sensor communications nodes, the signals being indicative of one or more fluid flow parameters; and
- sending acoustic signals from the sensor communications nodes to a receiver at a surface via the series of intermediate communications nodes and the topside communications node, node-to-node.

24. The method of claim 23, wherein the surface is an earth surface or production platform offshore.

25. The method of claim 23, wherein the one or more sensors for measuring fluid flow parameters are any of:
- (i) fluid velocity measurement devices residing inside of the production tubing;
- (ii) temperature sensors that measure temperature of fluids flowing inside of the production tubing;

(iii) pressure sensors that measure pressure inside of the production tubing, or pressure drop across a gas lift valve;

(iv) fluid density sensors that measure the density of fluids inside of the production tubing;

(v) microphones that provide passive acoustic monitoring to listen for the sound of gas entry into the production tubing or the opening and closing of the gas lift valve;

(vi) ultrasound sensors that correlate changes in gas transmission with gas flows, bubbles, solids and other properties of flow along gas inlets;

(vii) Doppler shift sensors;

(viii) chemical sensors;

(ix) an imaging device; and (x) combinations thereof; and each of the one or more sensor communications nodes is configured to receive signals from the associated sensor, and relay acoustic signals indicative of readings taken by the sensors.

26. The method of claim 25, wherein:

the one or more gas lift valves comprises at least two gas lift valves; and the packet of information in each signal relayed by the transceivers further comprises an identifier for the sensor communications node that originally transmitted the signal.

27. The method of claim 26, wherein:

the wellbore comprises a production packer sealing an annulus between the production tubing and a surrounding string of casing;

each of the at least two gas lift valves resides above the production packer.

28. The method of claim 26, wherein the intermediate communications nodes are spaced apart such that each intermediate communications node resides on its own joint of production tubing.

29. The method of claim 26, wherein:

the intermediate communications nodes are spaced at about 10 to 100 foot (3.0 to 30.5 meter) intervals; and the transceivers transmit data in acoustic form at a rate exceeding about 50 bps.

30. The method of claim 28, wherein the intermediate communications nodes transmit data representing the waveforms at a rate exceeding about 50 bps.

31. The method of claim 28, wherein a frequency band for the acoustic wave transmission by the transceivers is about 25 KHz wide.

32. The method of claim 28, wherein a frequency band for the acoustic wave transmission by the transceivers operates from about 75 kHz to 250 kHz.

33. The method of claim 28, wherein the acoustic waves provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

34. The method of claim 28, wherein:

each of the one or more sensors resides within the housing of its associated sensor communications node; and an electro-acoustic transducer within the associated sensor communications node converts signals from the sensors into acoustic signals.

35. The method of claim 28, wherein:

a well head is placed above the wellbore; and the topside communications node is placed (i) on an outer surface of the well head, or (ii) on an outer surface of an uppermost joint of the pipe string.

36. The method of claim 28, wherein each of the intermediate communications nodes is attached to an outer wall of a joint of pipe by (i) an adhesive material, (ii) welding, or (iii) one or more mechanical fasteners.

37. The method of claim 28, wherein each of the sensor communications nodes also comprises an electro-acoustic transducer and associated transceiver residing within a housing, with the transceiver being designed to relay signals from node-to-node up the wellbore representing the fluid flow data.

38. The method of claim 37, wherein at least one intermediate communications node resides between adjacent sensor communications nodes.

39. The method of claim 37, wherein each of the at least two gas lift valves resides in a side pocket mandrel.

40. The method of claim 37, wherein the transceiver in each sensor communications node is configured to send its acoustic signals indicative of fluid flow data (i) according to a pre-programmed schedule, (ii) in the event that a condition of gas lift valve failure is identified, or (iii) only when interrogated by a user at the surface.

41. The method of claim 37, wherein:

each of the one or more sensors resides adjacent to the housing of its associated sensor communications node;

each of the one or more sensors is in electrical communication with its corresponding sensor communications node; and the electro-acoustic transducer within the associated sensor communications node converts signals from the sensors into acoustic signals for the associated transceivers.

42. The method of claim 28, wherein:

each of the sensor communications nodes is attached to the pipe string by one or more clamps; and the step of attaching the sensor communications nodes to the pipe string comprises clamping the communications nodes to an outer surface of the production tubing or a gas lift valve.

43. The method of claim 28, wherein the one or more sensors communicates electrically with the transducer of the associated sensor communications node wirelessly.

44. The method of claim 43, further comprising:

running each of the sensors into the wellbore on a working string after production from the wellbore has commenced; and affixing each of the sensors to an inner diameter of the production tubing adjacent a side pocket mandrel or to an inside of a side pocket mandrel.

45. The method of claim 43, further comprising:

affixing each of the sensors to a gas lift valve before or after production from the wellbore has commenced;

running the gas lift valves sequentially into the wellbore at the end of a working string; and inserting each gas lift valve into an associated side pocket mandrel along the production tubing.

46. The method of claim 45, further comprising:

analyzing the signals to evaluate operation of the at least two gas lift valves.

* * * * *